US011371695B2

(12) United States Patent
Otani et al.

(10) Patent No.: US 11,371,695 B2
(45) Date of Patent: Jun. 28, 2022

(54) BOILER

(71) Applicants: MIURA CO., LTD., Matsuyama (JP); Clean Planet Inc., Tokyo (JP)

(72) Inventors: Kazuyuki Otani, Matsuyama (JP); Nobuyuki Ishizaki, Matsuyama (JP); Kazunobu Inoue, Matsuyama (JP); Hidetaka Yamamoto, Matsuyama (JP)

(73) Assignees: MIURA CO., LTD., Matsuyama (JP); Clean Planet Inc., Tokyo (JP)

( * ) Notice: Subject to any disclaimer, the term of this patent is extended or adjusted under 35 U.S.C. 154(b) by 44 days.

(21) Appl. No.: 17/064,927

(22) Filed: Oct. 7, 2020

(65) Prior Publication Data

US 2021/0123596 A1 Apr. 29, 2021

(30) Foreign Application Priority Data

Nov. 15, 2019 (JP) ..... JP2019-207481
Mar. 16, 2020 (JP) ..... JP2020-045123
Jul. 27, 2020 (JP) ..... JP2020-126761

(51) Int. Cl.

| | |
|---|---|
| ***F22B 3/02*** | (2006.01) |
| ***F22B 35/00*** | (2006.01) |
| ***F28F 27/02*** | (2006.01) |
| ***F22B 15/00*** | (2006.01) |
| *F23D 14/00* | (2006.01) |

(52) U.S. Cl.

CPC ..... *F22B 35/00* (2013.01); *F22B 15/00* (2013.01); *F28F 27/02* (2013.01); *F23D 14/00* (2013.01)

(58) Field of Classification Search

CPC .... F22B 3/02; F22B 1/18; F22B 37/00; C21B 3/00; F24V 30/00; F24V 30/02

See application file for complete search history.

(56) References Cited

U.S. PATENT DOCUMENTS 7,600,489 B2 * 10/2009 Lomax, Jr. ..... F28F 19/06 122/31.1
7,832,364 B2 * 11/2010 Liu ..... C01B 3/323 122/18.1
8,051,637 B2 * 11/2011 Labrador ..... F03G 7/00 60/39.01
8,962,204 B2 * 2/2015 Yonekura ..... H01M 8/04753 429/434

(Continued)

FOREIGN PATENT DOCUMENTS

CN 203893144 U 10/2014
EP 3896364 A1 * 12/2019

(Continued)

*Primary Examiner* — Gregory A Wilson
(74) *Attorney, Agent, or Firm* — Kenichiro Yoshida

(57) ABSTRACT

Provided is a boiler for heating fluid by a heat generation unit including heat generation bodies in a container, the boiler being able to moderately heat fluid according to various situations while heat generated by the heat generation bodies can be efficiently utilized. A boiler for heating fluid by using heat generated by heat generation bodies includes the heat generation bodies and a container having the heat generation bodies inside and configured such that the inside of the container is filled with gas with higher specific heat than that of air. The boiler includes a controller configured to control a heat generation amount of the heat generation body under a situation where the gas has been supplied into the container.

23 Claims, 12 Drawing Sheets

(56) References Cited

U.S. PATENT DOCUMENTS

| | | | | |
|---|---|---|---|---|
| 9,182,365 | B2 | 11/2015 | Kidwell | |
| 2019/0006695 | A1* | 1/2019 | Swiegers | C25B 11/031 |
| 2019/0257551 | A1* | 8/2019 | Iwamura | C01B 4/00 |
| 2019/0372449 | A1* | 12/2019 | Mills | H02K 44/085 |
| 2021/0380407 | A1* | 12/2021 | Ashton | C01B 3/24 |

FOREIGN PATENT DOCUMENTS

| | | | |
|---|---|---|---|
| JP | 54-077342 | A | 6/1979 |
| JP | 63-182596 | A | 7/1988 |
| JP | 5-196201 | A | 8/1993 |
| JP | 7-243605 | A | 9/1995 |
| JP | 10-319169 | A | 12/1998 |
| JP | 11-108308 | A | 4/1999 |
| JP | 2001-248831 | A | 9/2001 |
| JP | 2005-85663 | A | 3/2005 |
| JP | 2017-203563 | A | 11/2017 |
| JP | 2018-132284 | A | 8/2018 |
| JP | 6448074 | B2 | 12/2018 |
| WO | 2015/008859 | A2 | 1/2015 |

* cited by examiner

BOILER

CROSS-REFERENCE TO RELATED APPLICATIONS

The present application is made based on Japanese Patent Application No. 2019-207481 filed on Nov. 15, 2019 in Japan, Japanese Patent Application No. 2020-045123 filed on Mar. 16, 2020 in Japan, Japanese Patent Application No. 2020-126761 filed on Jul. 27, 2020 in Japan, and PCT/JP2019/041898 filed on Oct. 25, 2019, the entire contents thereof are incorporated herein by reference.

BACKGROUND OF THE INVENTION

1. Field of the Invention

The present invention relates to a boiler.

2. Description of the Related Art

Typically, a boiler has been broadly utilized for various purposes including industrial and commercial purposes. In the boiler, a heat generation unit configured to heat supplied fluid such as water or a heat medium is provided, and as one form of the heat generation unit, there is one provided with a heat generation body in a container.

There are various specific forms of the above-described heat generation unit, and as one example thereof, one including, in a container, a heat generation body (a reactant) configured such that multiple metal nanoparticles made of hydrogen storing metal or hydrogen storing alloy are formed on a surface has been disclosed as a heat generation system in Japanese Patent No. 6448074 (Patent Literature 1). According to Patent Literature 1, it has been described that in the heat generation system, hydrogen-based gas contributing to heat generation is supplied into the container to store hydrogen atoms in the metal nanoparticles and excess heat is generated.

Note that as also described in Patent Literature 1, an announcement that the heat generation body produced from palladium is provided in the container and heat generation reaction is made by heating the inside of the container while heavy hydrogen gas is being supplied into the container has been released. Moreover, regarding a heat generation phenomenon that the excess heat (an output enthalpy higher than an input enthalpy) is generated utilizing the hydrogen storing metal or the hydrogen storing alloy, details of the mechanism for generating the excess heat have been discussed among researchers of each country, and it has been reported that the heat generation phenomenon has occurred. Note that as a document regarding the present technical field, there is U.S. Pat. No. 9,182,365 (Patent Literature 2) in addition to Patent Literature 1.

It is important for the boiler configured to heat fluid by the heat generation unit including the heat generation body in the container to moderately heat fluid according to various situations while heat generated by the heat generation body can be efficiently utilized. For example, in a case where a steam amount (a steam load) required for the boiler from the outside varies, water heating needs to be reduced under a situation where the steam load is relatively low, and needs to be accelerated under a situation where the steam load is relatively high.

SUMMARY OF THE INVENTION

The present invention has been made in view of the above-described problems. An object of the present invention is to provide a boiler for heating fluid by a heat generation unit including heat generation bodies in a container, the boiler being configured so that fluid can be moderately heated according to various situations while heat generated by the heat generation bodies can be efficiently utilized.

The boiler according to the present invention is a boiler for heating fluid by using heat generated by a heat generation body, the boiler including the heat generation body and a container having the heat generation body inside and configured such that the inside of the container is filled with gas with higher specific heat than that of air. The boiler includes a controller configured to control a heat generation amount of the heat generation body under a situation where the gas has been supplied into the container. According to the present configuration, fluid is heated by a heat generation unit including the heat generation body in the container, and can be moderately heated according to various situations while heat generated by the heat generation body can be efficiently utilized. More specifically, as the above-described configuration, it may be configured such that the boiler includes, as a path for circulating the gas, a circulation path having, as part thereof, the inside of the container.

More specifically, as the above-described configuration, it may be configured such that the gas is hydrogen-based gas and the heat generation body is a reactant configured such that a metal nanoparticle made of hydrogen storing metals is provided on a surface and a hydrogen atom is stored in the metal nanoparticle to generate excess heat. Note that the hydrogen-based gas in the present application is heavy hydrogen gas, light hydrogen gas, or a combination thereof. Moreover, the "hydrogen storing metals" in the present application means hydrogen storing metal such as Pd, Ni, Pt, or Ti or hydrogen storing alloy containing one or more types of these metals.

More specifically, as the above-described configuration, it may be configured such that the boiler further includes a heater and the controller adjusts a gas circulation amount in the circulation path or the temperature of the heater to control the heat generation amount.

More specifically, as the above-described configuration, it may be configured such that the boiler further includes a burner and the controller adjusts the gas circulation amount in the circulation path or the temperature of the burner to control the heat generation amount. More specifically, as the above-described configuration, it may be configured such that the boiler further includes, as the burner, a hydrogen-powered burner configured to burn hydrogen-based gas and a common hydrogen-based gas supply source is provided for the hydrogen-powered burner and the inside of the container.

More specifically, as the above-described configuration, it may be configured such that the boiler supplies, to the outside, steam generated by heating of water as the fluid and the controller controls the heat generation amount based on the pressure of the steam supplied to the outside. According to the present configuration, the heat generation amount of the heat generation body is easily controlled such that the steam pressure is adjusted to a proper value. More specifically, as the above-described configuration, it may be configured such that the boiler heats a heat medium as the fluid to supply the heat medium to the outside and the controller controls the heat generation amount based on the temperature of the heated heat medium.

More specifically, as the above-described configuration, it may be configured such that the boiler further includes a heat transfer pipe configured such that the fluid flows inside and the heat transfer pipe is arranged to surround the heat generation body. According to the present configuration, heat generated by the heat generation body can be extremely efficiently transmitted to water targeted for heating.

More specifically, as the above-described configuration, it may be configured such that the heat transfer pipe spirally extends and is arranged to surround the heat generation body. More specifically, as the above-described configuration, it may be configured such that the heat transfer pipe includes multiple water pipes extending in the vertical direction and the water pipes are arranged to surround the heat generation body. More specifically, as the above-described configuration, it may be configured such that the heat transfer pipe is heated by conduction, convection, and radiation of heat generated by the heat generation body.

More specifically, as the above-described configuration, it may be configured such that the boiler further includes a heat exchanger provided outside the container and configured such that fluid as the gas heated by the heat generation body or a heat medium heat-exchanged with the gas passes through a heating side and a bypass path provided in parallel with the heat exchanger and bypassing the heating side of the heat exchanger. More specifically, as the above-described configuration, it may be configured such that the controller adjusts the flow rate of the fluid flowing in the bypass path based on the pressure of steam supplied from the heat exchanger to the outside. More specifically, as the above-described configuration, it may be configured such that the controller adjusts the flow rate and the heat generation amount of the heat generation body based on the pressure of the steam supplied from the heat exchanger to the outside.

More specifically, as the above-described configuration, it may be configured such that the boiler further includes a gas pump provided in the circulation path and a gas receiving portion provided on a primary side of the gas pump and configured to receive the gas from the outside. More specifically, as the above-described configuration, it may be configured such that the circulation path connects an upper portion and a lower portion of the container. More specifically, as the above-described configuration, it may be configured such that the heat transfer pipe is placed between a side wall of the container and the heat generation body. More specifically, as the above-described configuration, it may be configured such that the boiler includes a water pipe to be heated by heat generated by the heat generation body and heats water as the fluid when the water passes through the water pipe and the water pipe is arranged to surround the heat generation body.

The above-described object and features and other objects and features of the present invention are more clarified with reference to the following description of preferred embodiments and the attached drawings illustrating as follows.

DESCRIPTION OF THE PREFERRED EMBODIMENTS

Hereinafter, a boiler according to each embodiment of the present invention will be described with reference to each drawing.

1. First Embodiment

Figure 1:
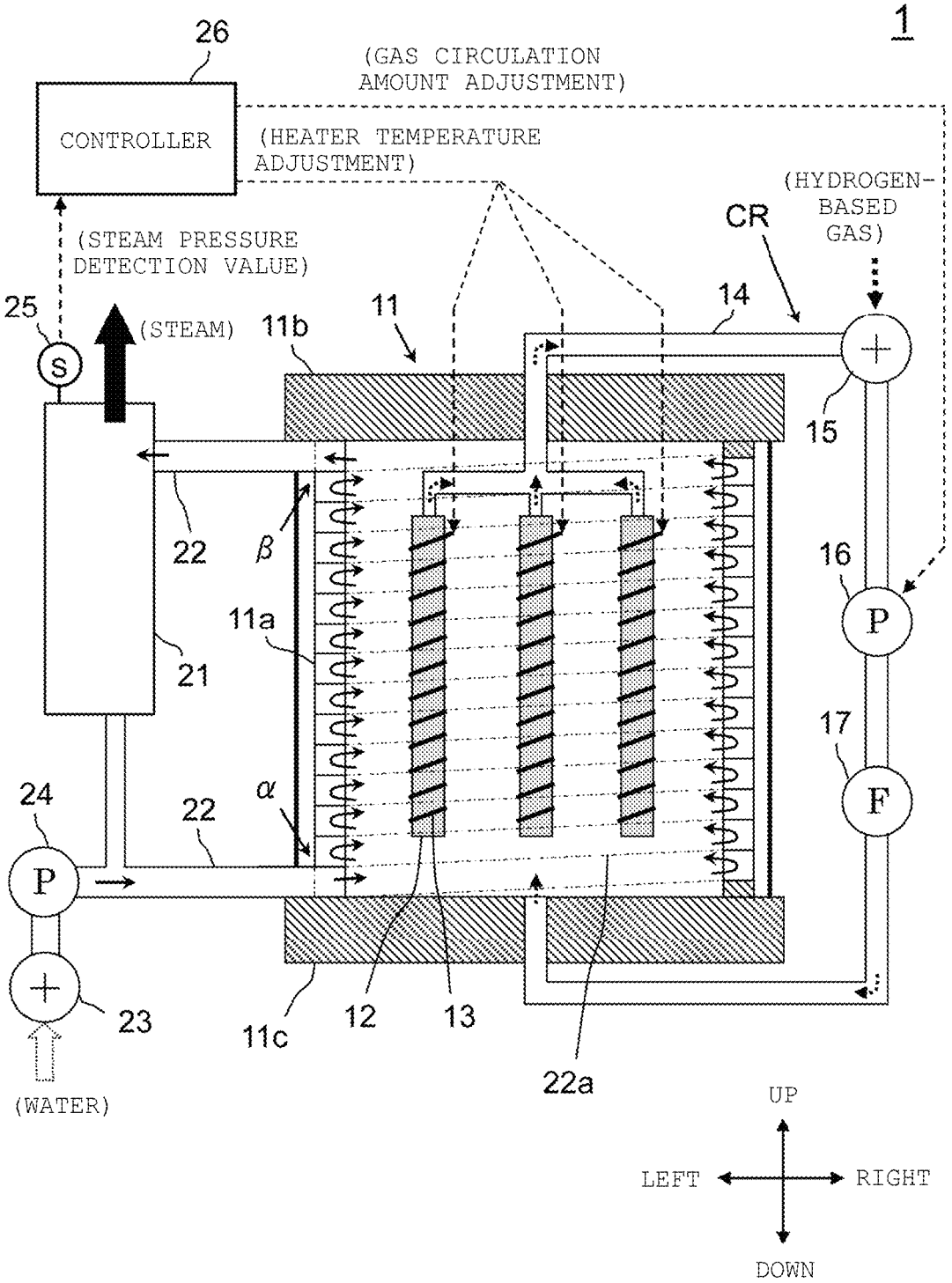
FIG. 1 is a schematic configuration diagram of a boiler 1 according to a first embodiment.

First, a first embodiment of the present invention will be described. FIG. 1 is a schematic configuration diagram of a boiler 1 according to the first embodiment. As illustrated in this figure, the boiler 1 includes a container 11, reactants 12, heaters 13, a gas path 14, a gas receiving portion 15, a gas pump 16, a gas filter 17, a separator 21, a fluid path 22, a water receiving portion 23, a water pump 24, a pressure sensor 25, and a controller 26.

Note that the states of the container 11 and the inside thereof in FIG. 1 (the same also applies to FIG. 4 and the like as described later) are illustrated as schematic sectional views along a plane cutting the container 11 substantially in half, and upper, lower, right, and left directions (an upper-lower direction is coincident with the vertical direction) are illustrated as in this figure. Moreover, chain lines illustrated in FIG. 1 (the same also applies to FIG. 4 and the like) schematically indicate arrangement of a heat transfer pipe 22*a*.

The container 11 is, as a whole, formed in a cylindrical shape having bottoms at both upper and lower ends in the upper-lower direction as an axial direction, and is formed so that gas can be sealed inside. More specifically, the container 11 has a cylindrical side wall 11*a* formed by the later-described heat transfer pipe 22*a*, and the upper side of the side wall 11*a* is closed by an upper bottom portion 11*b* and the lower side of the side wall 11*a* is closed by a lower bottom portion 11*c*. Note that in the present embodiment, the side wall 11*a* of the container 11 is in the cylindrical shape as one example, but may be formed in other tubular shapes. Alternatively, a can body cover may be placed at the outer periphery of the side wall 11*a*, and a heat insulating member may be provided between the side wall 11*a* and the can body cover. Alternatively, the side wall 11*a* itself may have a can body cover function, and placement of the can body cover may be omitted.

The reactant 12 is configured such that many metal nanoparticles are provided on a surface of a carrier formed in a fine mesh shape as a whole. Hydrogen storing alloys (hydrogen storing metal or hydrogen storing alloy) are applied as the material of this carrier, and the carrier is formed in a cylindrical shape having bottoms at both upper and lower ends in the upper-lower direction as the axial direction. An upper surface of the reactant 12 is connected to the gas path 14 so that gas having flowed into the reactant 12 through mesh-shaped clearances thereof can be delivered into the gas path 14. In the example of the present embodiment, three reactants 12 are provided next to each other in a right-left direction in the container 11.

The heater 13 is spirally wound around a side surface of the reactant 12 formed in the bottomed cylindrical shape, and is formed to generate heat by using supplied power. For example, a ceramic heater may be employed as the heater 13. The heater 13 generates heat to heat the reactant 12 so that the temperature of the reactant 12 can be increased to a predetermined reaction temperature at which reaction for generating later-described excess heat is easily made. Note that the controller 26 controls a power supply to the heater 13 so that the temperature of the heater 13 can be adjusted.

The control of the power supply to the heater 13 by the controller 26 may be performed such that the temperature of the heater 13 approaches a target value. For example, the controller 26 may increase the power supply to the heater 13 in a case where the controller 26 detects the temperature of the heater 13 and such a detection value is lower than the target value, and may decrease the power supply to the heater 13 in a case where the detection value is higher than the target value.

The gas path 14 is provided outside the container 11, and forms a gas circulation path CR including, as part thereof, the inside of the container 11. One end portion of the gas path 14 is connected to the upper surface of each reactant 12, and the other end portion is connected to the inside of the container 11. More specifically, portions of the gas path 14 connected to the upper surfaces of the reactants 12 are joined together in the container 11, and after having penetrated the upper bottom portion 11*b* as a single path, further penetrate the lower bottom portion 11*c* through the gas receiving portion 15, the gas pump 16, and the gas filter 17 and are connected to the inside of the container 11.

The gas receiving portion 15 receives a supply of hydrogen-based gas (heavy hydrogen gas, light hydrogen gas, or a combination thereof) from an external supply source, and causes the supplied hydrogen-based gas to flow into the gas path 14. For example, in a case where the hydrogen-based gas is supplied from a tank storing the hydrogen-based gas in advance to the gas receiving portion 15, such a tank is a hydrogen-based gas supply source.

For example, the rotational speed of the gas pump 16 is controlled by inverter control, and with a flow rate according to this rotational speed, gas in the gas path 14 flows from an upstream side to a downstream side (i.e., to a direction indicated by dashed arrows in FIG. 1). Note that the controller 26 controls the rotational speed of the gas pump 16 so that a gas circulation amount in the gas circulation path CR including the gas path 14 can be adjusted.

This rotational speed control by the controller 26 may be performed such that the gas circulation amount in the gas circulation path CR approaches a target value. For example, the controller 26 may increase the rotational speed of the gas pump 16 to increase the circulation amount in a case where the controller 26 detects the circulation amount and such a detection value is lower than the target value, and may decrease the rotational speed of the gas pump 16 to decrease the circulation amount in a case where the detection value is higher than the target value.

The gas filter 17 removes an impurity (specifically, one as a cause for interference with the reaction for generating the excess heat in the reactant 12) contained in gas in the gas path 14. The separator 21 receives steam generated by heating of water (one example of fluid) through the heat transfer pipe 22*a*, and performs steam separation (separation of drain contained in such steam) for the steam. The steam separated in the separator 21 can be supplied to the outside of the boiler 1.

The fluid path 22 is a water path connected from the water receiving portion 23 to the separator 21. Part of the fluid path 22 is the heat transfer pipe 22*a* forming the side wall 11*a* as described above. Moreover, in the middle of the fluid path 22, the water pump 24 is arranged at a position immediately on the downstream side of the water receiving portion 23. Note that liquid water supplied from the water receiving portion 23 flows in the upstream-side path of the fluid path 22 with respect to the heat transfer pipe 22*a*, and water (steam) evaporated by heating in the heat transfer pipe 22*a* flows in the downstream-side path (between the container 11 and the separator 21) with respect to the heat transfer pipe 22*a*.

The water receiving portion 23 receives, as necessary, a supply of water as a steam source from the outside, and causes the supplied water to flow into the fluid path 22. The water pump 24 causes water in the fluid path 22 to flow from the upstream side to the downstream side (i.e., to a direction indicated by solid arrows in FIG. 1).

The heat transfer pipe 22*a* spirally extends from the lower bottom portion 11*c* to the upper bottom portion 11*b* to form the tubular side wall 11*a* of the container 11. That is, the heat transfer pipe 22*a* spirally extends in the axial direction (the upper-lower direction) of the tubular side wall 11*a* such that no clearance is formed between adjacent portions of the heat transfer pipe 22*a* in the upper-lower direction. Note that in the example of the present embodiment, the sectional shape of an inner wall of the heat transfer pipe 22*a* is in a rectangular shape, but may be a circular shape or other shapes.

The pressure sensor 25 continuously detects the pressure (hereinafter referred to as a "steam pressure") of steam supplied from the separator 21 to the outside. Note that a detection value (the value of the steam pressure) of the pressure sensor 25 is high under a situation where the amount of steam supplied from the boiler 1 is greater than a steam amount (a steam load) required from the outside, and conversely, is low under a situation where the amount of steam supplied from the boiler 1 is smaller. Information on the detection value of the pressure sensor 25 is continuously transmitted to the controller 26.

The controller 26 includes a computing device and the like, and controls a heat generation amount of the reactant 12 based on the detection value of the pressure sensor 25. Specific operation contents of the controller 26 will be described in detail again.

Next, operation of the boiler 1 will be described. In the boiler 1, the hydrogen-based gas is supplied from the external supply source to the gas receiving portion 15, and the gas circulation path CR including the inside of the container 11 and the gas path 14 is filled with the hydrogen-based gas. Due to action of the gas pump 16, the charged hydrogen-based gas circulates to the direction indicated by the dashed arrows in FIG. 1 in the gas circulation path CR.

At this point, in the container 11, the hydrogen-based gas is delivered into the gas path 14 connected to upper portions of the reactants 12 after having flowed in the reactants 12 through the mesh-shaped clearances thereof. At the same time, the reactants 12 are heated by action of the heaters 13. When the reactants 12 are, as described above, heated by the heaters 13 in a state in which the hydrogen-based gas has been supplied into the container 11, hydrogen atoms are stored in the metal nanoparticles provided on the reactants 12, and the reactants 12 generate an excess heat of equal to or higher than the temperature of heating by the heater 13. As described above, since the reactant 12 makes the reaction for generating the excess heat, the reactant 12 functions as a heat generation body. The principle of the reaction for generating the excess heat is, for example, similar to the principle of reaction for generating excess heat as disclosed in Patent Literature 1.

From the hydrogen-based gas in the gas circulation path CR including the inside of the container 11, the impurity is removed when the hydrogen-based gas passes through the gas filter 17. Thus, the high-purity hydrogen-based gas from which the impurity has been removed is continuously supplied into the container 11. With this configuration, the high-purity hydrogen-based gas can be stably provided to the reactants 12, a state in which the output of the excess heat is easily induced can be maintained, and the reactants 12 can effectively generate heat.

In parallel with the operation of generating heat from the reactants 12 as described above, water is supplied from the outside to the water receiving portion 23. The supplied water flows, due to action of the water pump 24, to the direction indicated by the solid arrows in FIG. 1 in the fluid path 22.

When passing through the heat transfer pipe 22*a* forming the side wall 11*a* of the container 11, the water flowing in the fluid path 22 is heated by heat generated by the reactants 12. That is, the heat generated by the reactants 12 is transmitted to the heat transfer pipe 22*a* by convection (heat transfer), heat conduction, and radiation by the hydrogen-based gas in the container 11, and the heat transfer pipe 22*a* of which temperature has been increased by such transmission heats the water flowing in the heat transfer pipe 22*a*.

Figure 2:
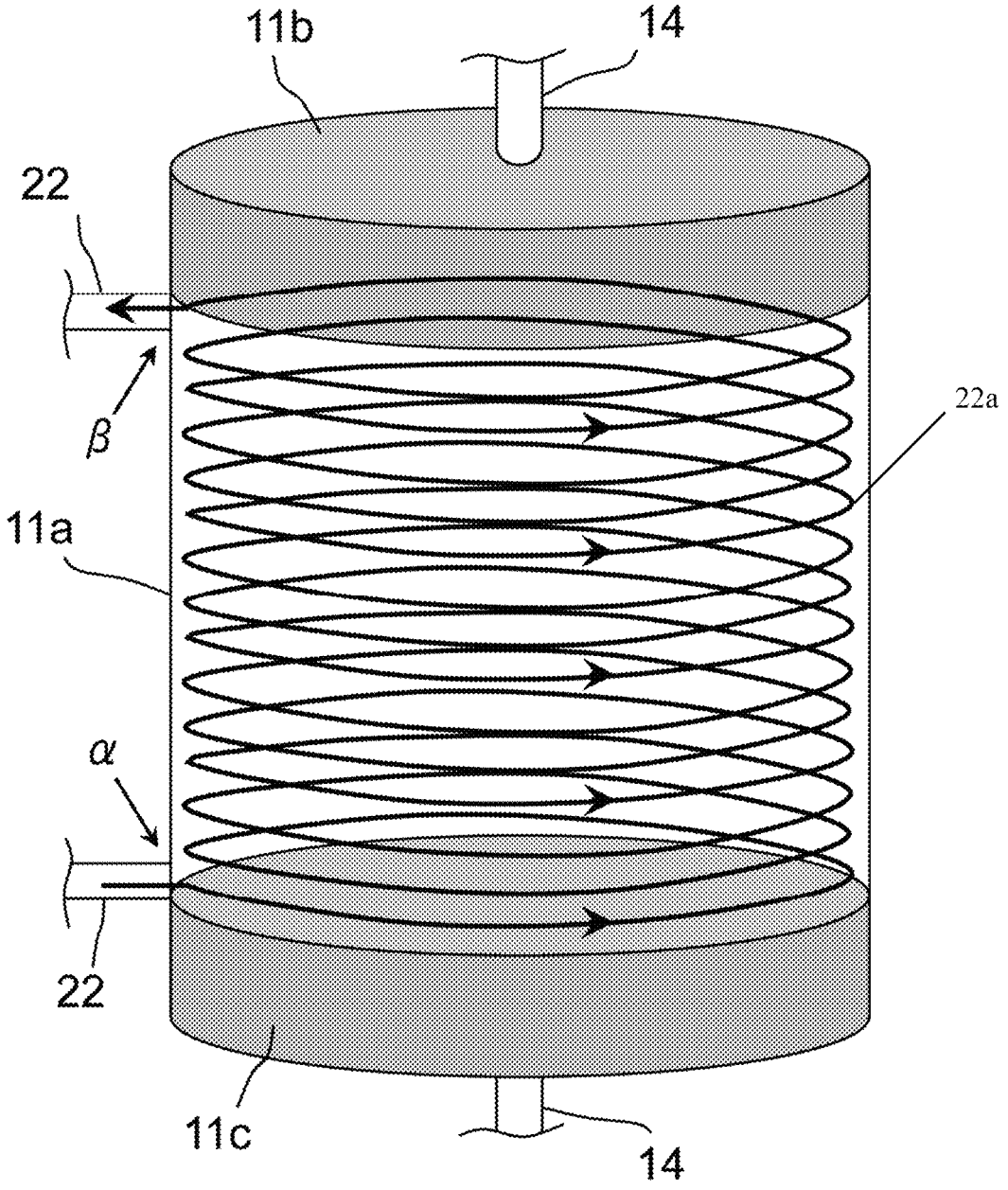
FIG. 2 is a view for describing the course of water passing through a heat transfer pipe of the boiler 1.

FIG. 2 schematically illustrates the course of water passing through the heat transfer pipe 22*a* by a solid arrow. As illustrated in this figure, water having entered the heat transfer pipe 22*a* through an inlet α (the lowermost portion of the heat transfer pipe 22*a*) of the heat transfer pipe 22*a* flows along a spirally-extending path in the heat transfer pipe 22*a*, and is discharged as steam toward the separator 21 through an outlet β (the uppermost portion of the heat transfer pipe 22*a*) of the heat transfer pipe 22*a*. At this point, heat from the heat transfer pipe 22*a* (the side wall 11*a* of the container 11) heated by heat generated by the reactants 12 is transmitted to the water passing through the heat transfer pipe 22*a*, and the temperature of the water increases.

In this manner, the water flowing in the fluid path 22 is heated when passing through the heat transfer pipe 22*a*, and the temperature thereof increases. Eventually, the water turns into steam. Such steam is delivered to the separator 21, and after the dryness of the steam has been increased by steam separation, is supplied to the outside of the boiler 1.

The amount of steam supplied from the separator 21 to the outside can be, for example, adjusted according to the amount of steam required from the outside. Moreover, in the boiler 1, water is sequentially supplied to the water receiving portion 23 by an amount corresponding to a steam supply to the outside, i.e., a water decrement, and steam can be continuously generated and supplied to the outside.

The amount of heat generation by the reactant 12 as described herein varies according to the temperature of the heater 13 and the hydrogen-based gas circulation amount. That is, as the temperature of the heaters 13 increases, the reaction for generating the excess heat in the reactant 12 is more accelerated, and the heat generation amount of the reactant 12 increases. Moreover, as the hydrogen-based gas circulation amount increases, more hydrogen-based gas in the container 11 acts on the reactant 12, the reaction for generating the excess heat is more accelerated, and the heat generation amount of the reactant 12 increases. Further, as the heat generation amount of the reactant 12 increases, heating of water in the heat transfer pipe 22*a* is more accelerated to generate more steam, and the steam pressure increases.

Utilizing this situation, the controller 26 controls the heat generation amount of the reactant 12 such that a proper steam pressure is brought (the detection value of the pressure sensor 25 falls within a preset proper range). A specific example of operation of the controller 26 will be described below with reference to a flowchart illustrated in FIG. 3.

The controller 26 acquires the latest information on the detection value of the pressure sensor 25, and continuously monitors whether or not such a detection value falls within the proper range (steps S1 to S3). This proper range is preferably properly set in advance according to, e.g., the specifications of the boiler 1 and the steam load.

In a case where the detection value exceeds the proper range (Yes at the step S2), the controller 26 adjusts the temperature of the heater 13 to decrease by a predetermined value A1 (a step S11), adjusts the hydrogen-based gas circulation amount to decrease by a predetermined value A2 (a step S12), and returns to operation at the step S1.

Note that each of the above-described values A1, A2 is preferably set so that the heat generation amount of the reactant 12 can be moderately changed. By execution of adjustment at the steps S11 to S12, the heat generation amount of the reactant 12 decreases, and the steam pressure decreases and approaches the proper range.

On the other hand, in a case where the detection value falls below the proper range (Yes at the step S3), the controller 26 adjusts the temperature of the heater 13 to increase by a predetermined value B1 (a step S21), adjusts the hydrogen-based gas circulation amount to increase by a predetermined value B2 (a step S22), and returns to operation at the step S1.

Note that each of the above-described values B1, B2 is preferably set so that the heat generation amount of the reactant 12 can be moderately changed. By execution of adjustment at the steps S21 to S22, the heat generation amount of the reactant 12 increases, and the steam pressure increases and approaches the proper range. By execution of a series of operation illustrated in FIG. 3, the heat generation amount of the reactant 12 can be controlled such that the steam pressure becomes proper.

Adjustment (adjustment of the temperature of the heater 13) at the steps S11, S21 can be implemented in such a manner that a power supply to the heater 13 is changed as necessary. Moreover, adjustment (adjustment of the hydrogen-based gas circulation amount) at the steps S12, S22 can be implemented in such a manner that the rotational speed of the gas pump 16 is changed as necessary.

Figure 3:
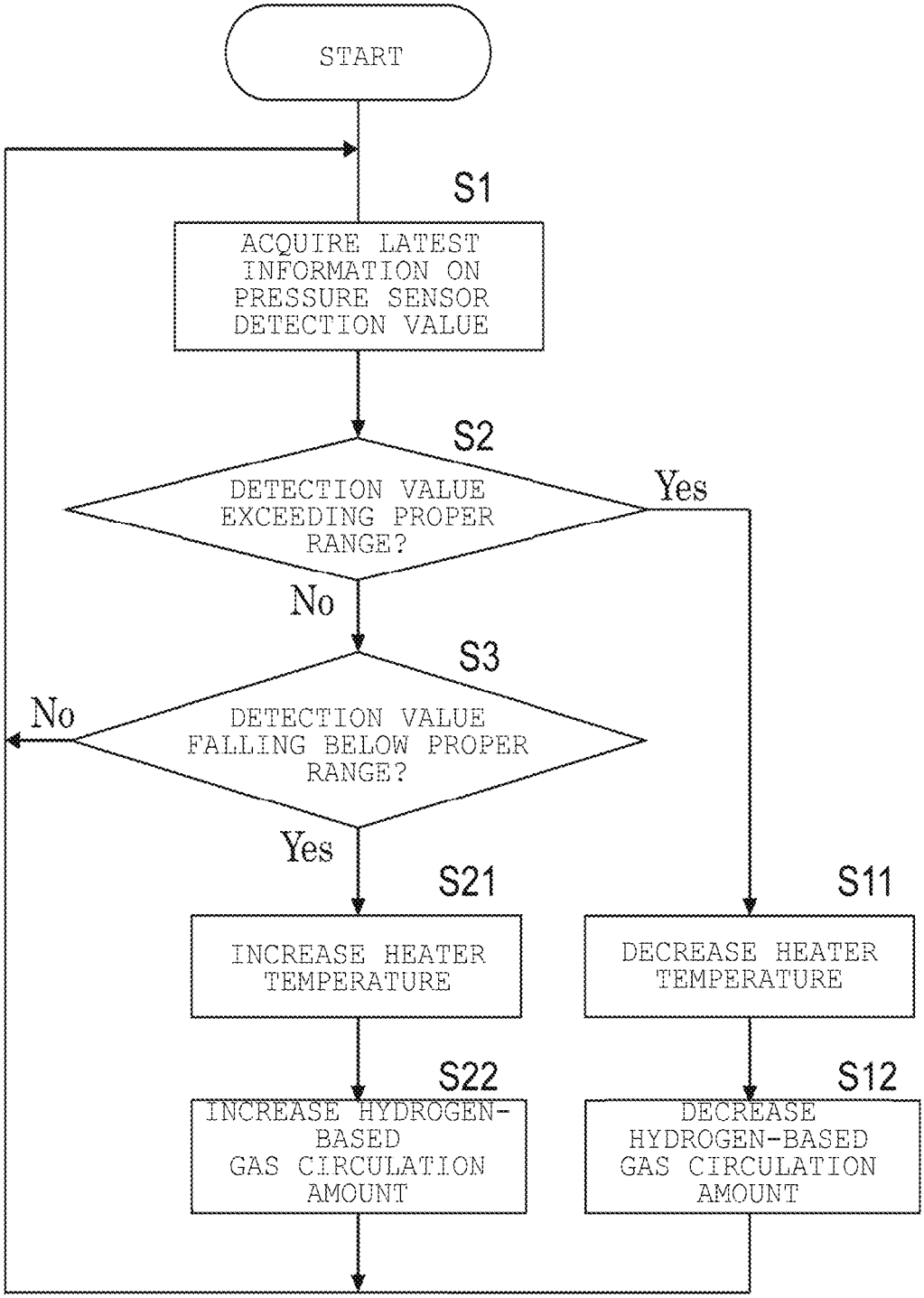
FIG. 3 is a flowchart regarding operation of a controller according to the first embodiment.

Moreover, in a series of operation illustrated in FIG. 3, both items of the temperature of the heater 13 and the hydrogen-based gas circulation amount are adjusted according to the detection value of the pressure sensor 25. With this configuration, the heat generation amount of the reactant 12 can be controlled while both items are changed with favorable balance. Note that according to various situations, only either one of the items may be adjusted instead of adjusting both items described above. As necessary, which one of these items is to be adjusted can be set.

Further, an acceptable range may be provided for the value of each of the above-described items, and operation of the controller 26 may be executed without deviating from this acceptable range. For example, under a situation where the temperature of the heater 13 has already reached the upper limit of the acceptable range, even in a case where the detection value of the pressure sensor 25 falls below the proper range (Yes at the step S3), adjustment (the step S21) for increasing the temperature of the heaters 13 may be omitted, and only adjustment (the step S22) for increasing the hydrogen-based gas circulation amount may be performed. With this configuration, an adverse effect (e.g., failure of the heater 13) due to an excessive increase in the temperature of the heater 13 can be prevented in advance.

2. Second Embodiment

Next, a second embodiment of the present invention will be described. Note that the second embodiment is basically similar to the first embodiment, except for the form of a heat generation body and points relating thereto. In description below, description of contents different from those of the first embodiment will be focused, and description of contents common to the first embodiment might be omitted.

Figure 4:
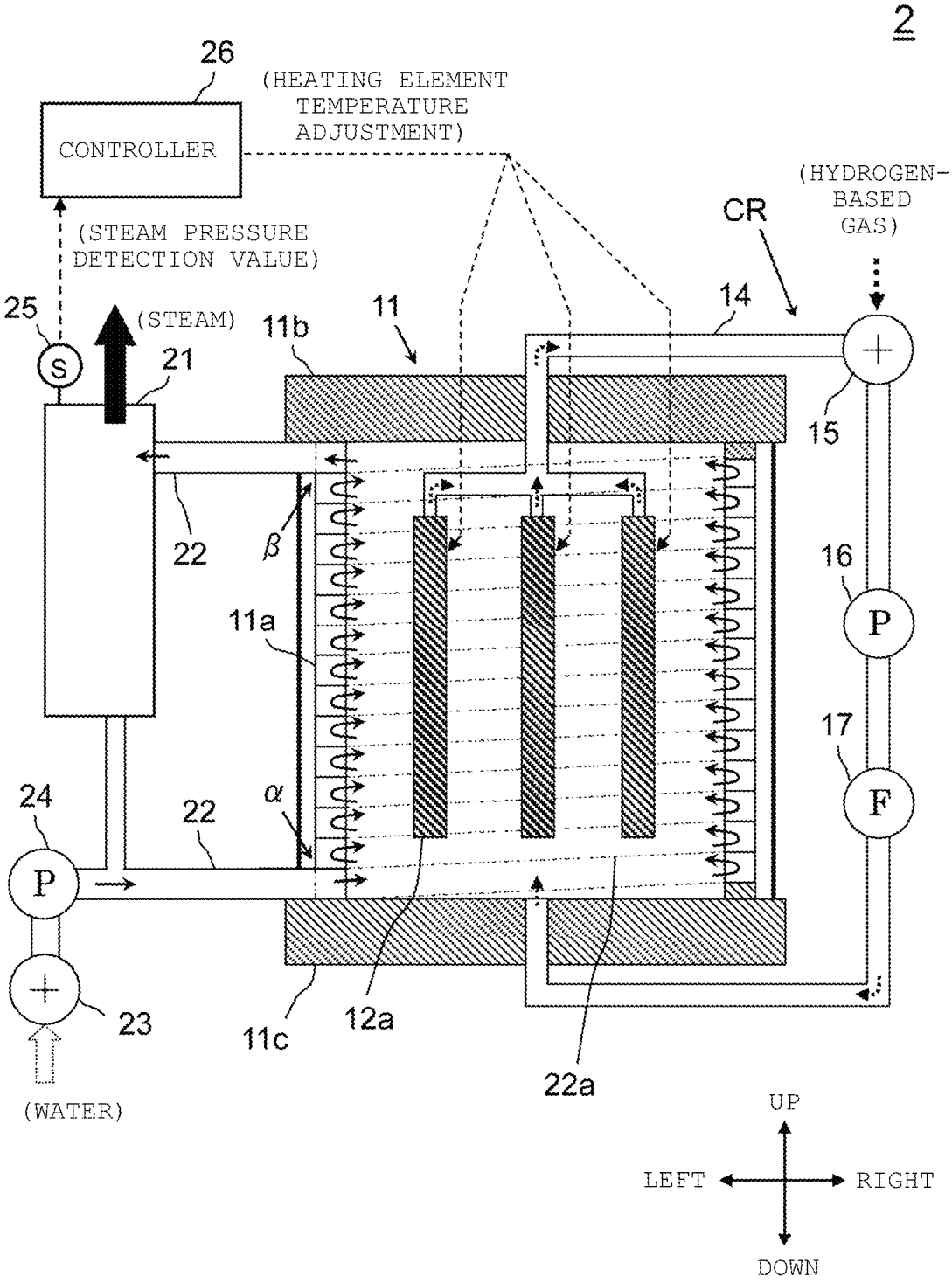
FIG. 4 is a schematic configuration diagram of a boiler 2 according to a second embodiment.

FIG. 4 is a schematic configuration diagram of a boiler 2 in the second embodiment. The reactant 12 is, as the heat generation body, employed in the boiler 1 of the first embodiment. Instead, a general heat generation element 12*a* is employed in the second embodiment. Note that the heat generation element 12*a* described herein is, as one example, a halogen heater configured to generate heat by a power supply. Moreover, for the sake of convenience, the shape and dimensions of the heat generation element 12*a* are similar to those of the reactant 12. In a case where the heat generation element 12*a* is applied as the heat generation body, excess heat is not necessarily generated as in the first embodiment, and one equivalent to a heater 13 is not necessary and placement thereof is omitted.

In the boiler 2, a heat transfer pipe 22*a* is heated by heat generated from the heat generation elements 12*a* instead of the reactants 12, and the heat from the heat transfer pipe 22*a* (a side wall 11*a* of a container 11) is transmitted to water passing through the heat transfer pipe 22*a*, and the temperature of the water increases. Moreover, in this form, the above-described reaction for generating the excess heat is not necessary, and the temperature of the heat generation element 12*a* is directly controlled by power control so that water can be moderately heated to generate steam.

Figure 5:
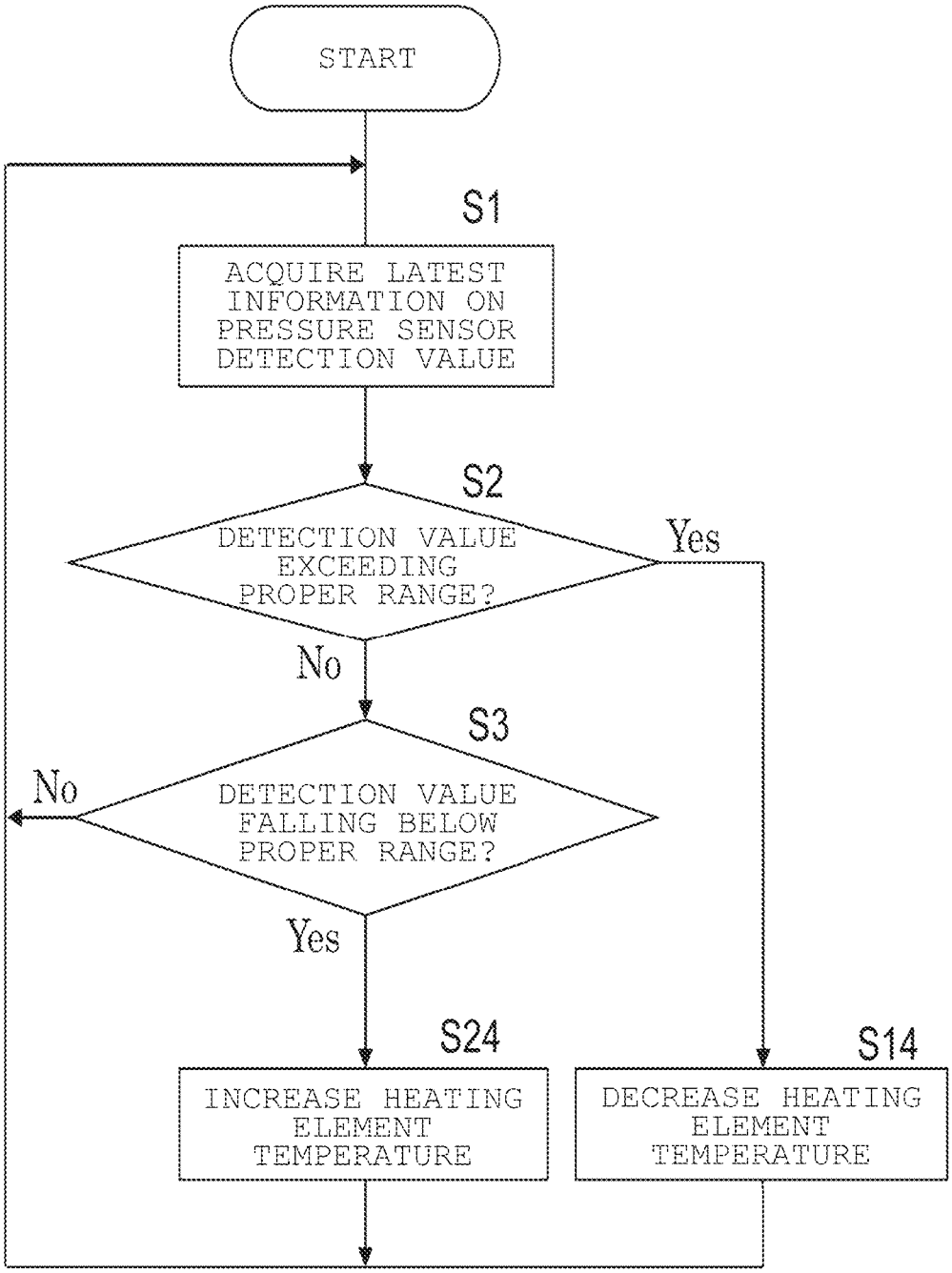
FIG. 5 is a flowchart regarding operation of a controller according to the second embodiment.

Moreover, in the boiler 2, a controller 26 adjusts the power supply to the heat generation element 12*a* so that a heat generation amount of the heat generation element 12*a* (the heat generation body) can be controlled. A specific example of operation of the controller 26 in the second embodiment will be described below with reference to a flowchart illustrated in FIG. 5.

The controller 26 acquires the latest information on a detection value of a pressure sensor 25, and continuously monitors whether or not such a detection value falls within a proper range (steps S1 to S3). This proper range is preferably properly set in advance according to, e.g., the specifications of the boiler 2 and a steam load.

In a case where the detection value exceeds the proper range (Yes at the step S2), the controller 26 adjusts the temperature of the heat generation element 12*a* to decrease by a predetermined value A4 (a step S14), and returns to operation at the step S1. Note that the above-described value A4 is preferably set so that the heat generation amount of the heat generation element 12*a* can be moderately changed. By execution of adjustment at the step S14, the heat generation amount of the heat generation element 12*a* decreases, and a steam pressure decreases and approaches the proper range.

On the other hand, in a case where the detection value falls below the proper range (Yes at the step S3), the controller 26 adjusts the temperature of the heat generation element 12*a* to increase by a predetermined value B4 (a step S24), and returns to operation at the step S1. Note that the above-described value B4 is preferably set so that the heat generation amount of the heat generation element 12*a* can be moderately changed. By execution of adjustment at the step S24, the heat generation amount of the heat generation element 12*a* increases, and the steam pressure increases and approaches the proper range. By execution of a series of operation illustrated in FIG. 5, the heat generation amount of the heat generation element 12*a* can be controlled such that the steam pressure becomes proper.

The boiler 1, 2 of each embodiment described above includes the heat generation bodies and the container 11 having the heat generation bodies inside, and is configured to heat supplied water to generate steam. Further, each boiler 1, 2 includes the heat transfer pipe 22*a* to be heated by heat generated by the heat generation bodies under environment where the inside of the container 11 is filled with gas (the hydrogen-based gas in the examples of the present embodiments) with higher specific heat than that of air, and water (water as the steam source) passing through the heat transfer pipe 22*a* is heated. Note that under, e.g., a condition of 1 atm at 200° C., the specific heat of air is about 1,026 J/Kg° C., and on the other hand, the specific heat of hydrogen is about 14,528 J/Kg° C. and is extremely higher than the specific heat of air. Moreover, as the heat generation body, the reactant 12 is employed in the boiler 1, and the heat generation element 12*a* is employed in the boiler 2.

According to each boiler 1, 2, heat generated by the heat generation bodies can be efficiently transmitted to water while such water is heated by a heat generation unit including the heat generation bodies in the container 11 to generate steam. As a result, the heat generated by the heat generation bodies can be efficiently transmitted to the water as the steam source.

Further, the inside of the container 11 is filled with gas with higher specific heat than that of air, and therefore, heat transfer can be favorably performed as compared to the case of charging general air, and heat generated by the heat generation bodies can be efficiently transmitted to water as the steam source. Moreover, due to high specific heat, it is less likely to fluctuate the temperature of gas, and heat can be more stably transmitted to water.

Moreover, the heat transfer pipe 22*a* forms the entire periphery of the side wall 11*a* formed in the tubular shape, and therefore, heat generated by the heat generation bodies can be efficiently transmitted to water as the steam source. Specifically, the heat transfer pipe 22*a* in the present embodiments is arranged to surround the heat generation bodies, and therefore, the substantially entire area of the periphery of the side wall 11*a* can be covered and heat generated by the heat generation bodies can be transmitted to water as the steam source with as least waste as possible. Note that in each of the above-described embodiments, the heat transfer pipe spirally extends and is arranged to surround the heat generation bodies, but the form surrounding the heat generation bodies is not limited to above. For example, a form in which multiple heat transfer pipes extending in the vertical direction are arranged to surround the heat generation bodies may be employed.

Moreover, in each of the above-described embodiments, the side wall 11*a* for sealing gas in the container 11 is formed by the heat transfer pipe 22*a*. Instead, the side wall 11*a* may be provided separately from the heat transfer pipe 22*a*, and the heat transfer pipe 22*a* may be provided inside the side wall 11*a* (i.e., in the container 11). In this case, under environment where the inside of the container 11 is filled with gas with higher specific heat than that of air, the heat transfer pipe 22*a* can be also heated by heat generated by the heat generation bodies. Moreover, in this case, the heat transfer pipe 22*a* does not necessarily fulfill a function as the side wall 11*a*, but preferably fulfills such a function because the heat transfer pipe 22*a* more easily receives heat from the heat generation bodies when there is a clearance between adjacent portions of the heat transfer pipe 22*a* in the upper-lower direction.

In each boiler 1, 2, the above-described gas circulates in the gas circulation path CR including, as part thereof, the inside of the container 11. With this configuration, the effect of accelerating gas motion in the container 11 and more effectively performing heat transfer from the gas to the side wall 11*a* is expected. Note that in the boiler 2 of the second embodiment not requiring the reaction for generating the excess heat, a mechanism configured to circulate gas in the container 11 may be omitted, and instead, a mechanism configured to supply gas into the container 11 to fill the container 11 with the gas may be provided. Moreover, the reaction for generating the excess heat is not necessary in the boiler 2, and therefore, gas other than the hydrogen-based gas may be employed as the above-described gas with higher specific heat than that of air.

Moreover, each boiler 1, 2 includes the controller 26 configured to control the heat generation amount of the heat generation body, and therefore, water can be moderately heated according to various situations. Specifically, in each of the above-described embodiments, the heat generation amount is controlled based on the steam pressure (the pressure of steam supplied to the outside), and therefore, is easily controlled such that the steam pressure is adjusted to a proper value. Note that the control of the heat generation amount of the heat generation body according to the present invention is not limited to the control based on the steam pressure, but may be control based on various other types of information.

Note that in each of the above-described embodiments, water as the steam source flows in the fluid path 22 including the heat transfer pipe 22*a*. Instead, a heat medium (fluid for a heat medium) may flow in the fluid path 22 so that water as the steam source can be heated using this heat medium.

3. Third Embodiment

Figure 6:
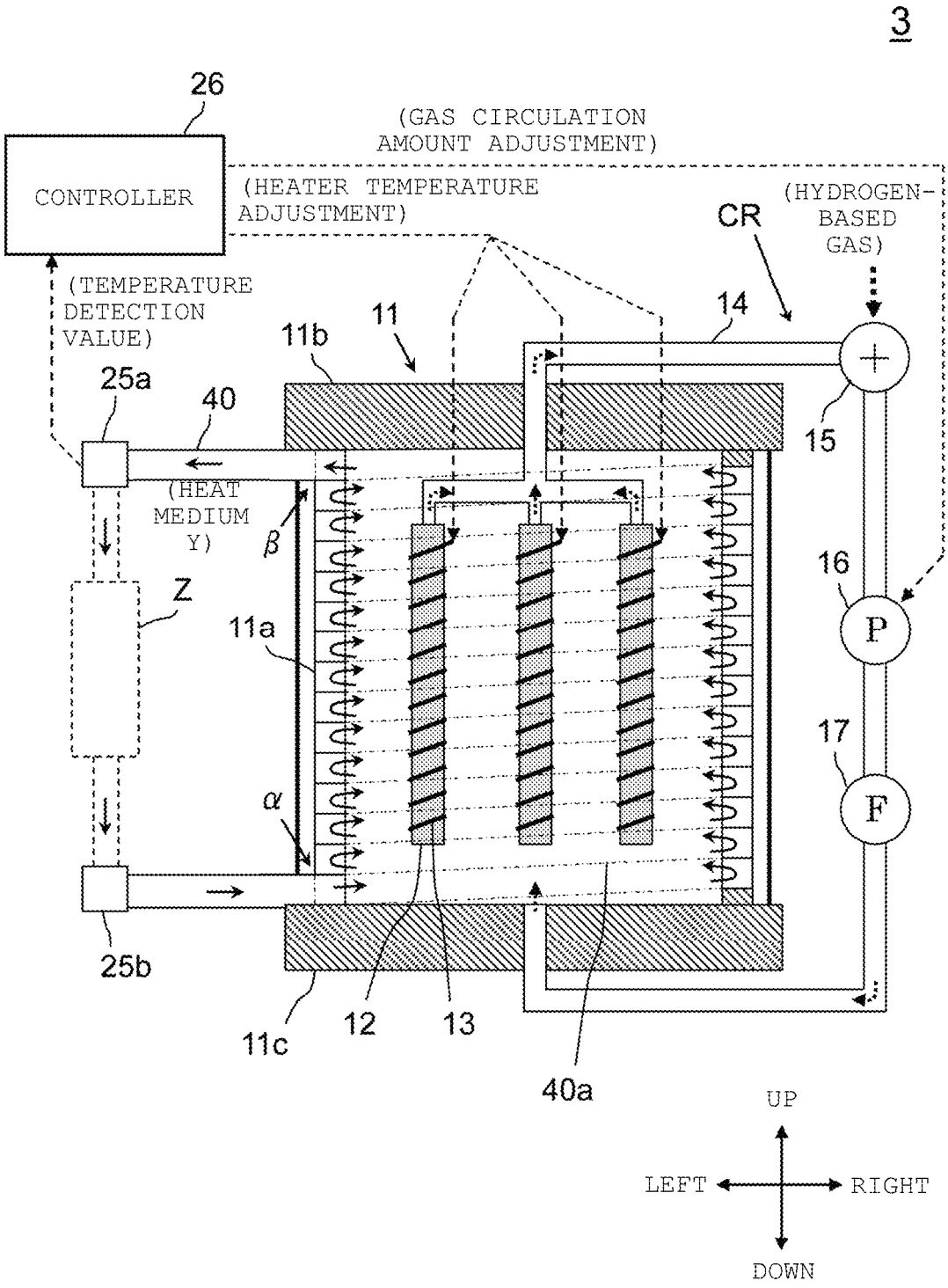
FIG. 6 is a schematic configuration diagram of a boiler 3 according to a third embodiment.

Next, a third embodiment of the present invention will be described. Note that in description below, description of contents different from those of the first embodiment will be focused, and description of contents common to the first embodiment might be omitted. FIG. 6 is a schematic configuration diagram of a boiler 3 in the third embodiment. The boiler 3 is configured as a heat medium boiler configured to supply a heat medium Y (one example of fluid) to a load Z, and instead of each portion 21 to 25 relating to a water supply or steam generation in the first embodiment, includes a heat medium path 40 in which the heat medium Y flows. Note that the heat medium path 40 includes a heat transfer pipe 40*a* having the same configuration as that of the heat transfer pipe 22*a* of the first embodiment and configured so that the heat medium Y can flow in the heat transfer pipe 40*a*, and the heat transfer pipe 40*a* spirally extends from a lower bottom portion 11*c* to an upper bottom portion lib of a container 11.

The heat medium path 40 includes a heat medium outlet 25*a* arranged on a downstream side with respect to the heat transfer pipe 40*a* and a heat medium inlet 25*b* arranged on an upstream side with respect to the heat transfer pipe 40*a*, and the load Z can be connected to between the heat medium outlet 25*a* and the heat medium inlet 25*b*. Note that as the load Z, various devise utilizing heat of the heat medium Y can be employed, for example. After having passed through the load Z, the heat medium Y having flowed out of the heat medium outlet 25*a* flows into the heat medium inlet 25*b*. With this configuration, the heat medium Y can circulate, in the boiler 3 connected to the load Z, in a circulation path including the heat medium path 40 and the load Z as indicated by solid arrows in FIG. 6, and heat generated by reactants 12 (heat generation bodies) can be continuously supplied to the load Z.

Moreover, in the boiler 3, a controller 26 can control a heat generation amount of the reactant 12 based on a detection value of the temperature of the heat medium Y obtained by, e.g., a temperature sensor. In the example of the present embodiment, the temperature (the outlet temperature of the heat medium Y) of the heat medium Y at the heat medium outlet 25*a* is detected, and based on such a temperature, the controller 26 controls the heat generation amount of the reactant 12.

More specifically, the controller 26 acquires, instead of operation (see FIG. 3) at the steps S1 to S3 in the first embodiment, the latest information on the detection value of the temperature of the heat medium Y, and continuously monitors whether or not such a detection value falls within a proper range. This proper range is preferably properly set in advance according to, e.g., the specifications of the boiler 3 and the load Z. In the present embodiment, when the temperature of the heat medium Y exceeds the proper range, the temperature of a heater 13 is decreased, and a hydrogen-based gas circulation amount is decreased. Conversely, when the temperature falls below the proper range, the temperature of the heater 13 is increased, and the hydrogen-based gas circulation amount is increased. In this manner, the heat generation amount of the reactant 12 can be controlled such that the temperature of the heat medium Y becomes proper.

Note that the specific form for controlling the heat generation amount of the reactant 12 based on the temperature of the heat medium Y is not limited to one described above. As one example, the temperature (a return port temperature of the heat medium Y) of the heat medium Y at the heat medium inlet 25*b* may be detected, and based on such a temperature, the controller 26 may control the heat generation amount of the reactant 12. As another example, the controller 26 may control the heat generation amount of the reactant 12 based on a difference between the temperature of the heat medium Y at the heat medium outlet 25*a* and the temperature of the heat medium Y at the heat medium inlet 25*b*.

4. Fourth Embodiment

Next, a fourth embodiment of the present invention will be described. Note that the fourth embodiment is basically similar to the first embodiment, except for the form of a heat generation body and points relating thereto. In description below, description of contents different from those of the first embodiment will be focused, and description of contents common to the first embodiment might be omitted.

Figure 7:
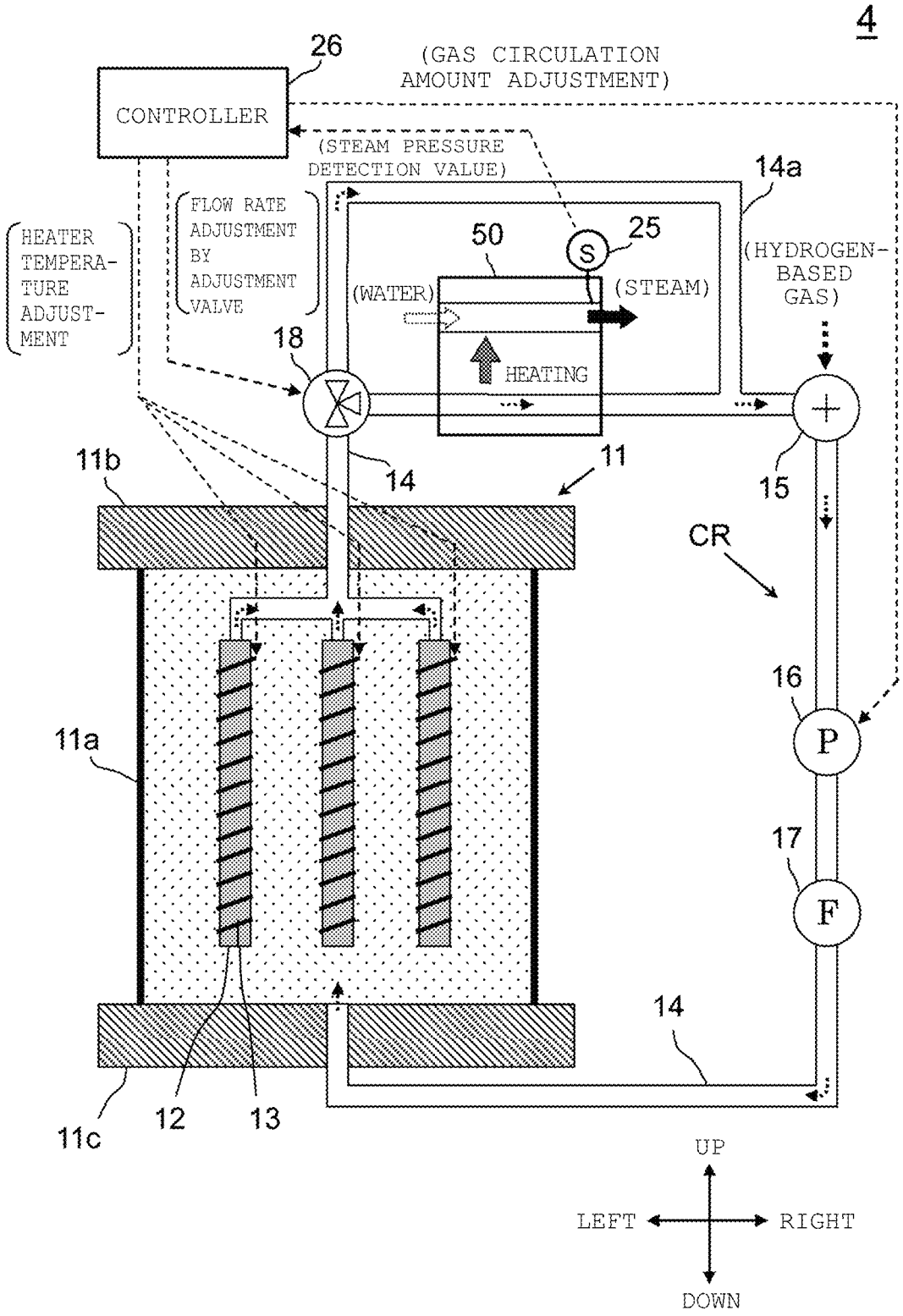
FIG. 7 is a schematic configuration diagram of a boiler 4 according to a fourth embodiment.

FIG. 7 is a schematic configuration diagram of a boiler 4 according to the fourth embodiment. As illustrated in this figure, the boiler 4 includes a container 11, reactants 12, heaters 13, a gas path 14, a gas receiving portion 15, a gas pump 16, a gas filter 17, a controller 26, a heat exchanger 50, and a pressure sensor 25.

The container 11 is, as a whole, formed in a cylindrical shape having bottoms at both upper and lower ends in an upper-lower direction as an axial direction, and is formed so that gas can be sealed inside. More specifically, the container 11 has a cylindrical side wall 11*a*, and the upper side of the side wall 11*a* is closed by an upper bottom portion 11*b* and the lower side of the side wall 11*a* is closed by a lower bottom portion 11*c*. Note that in the present embodiment, the side wall 11*a* of the container 11 is in the cylindrical shape as one example, but may be formed in other tubular shapes. Alternatively, a can body cover may be placed at the outer periphery of the side wall 11*a*, and a heat insulating member may be provided between the side wall 11*a* and the can body cover.

The gas path 14 is provided outside the container 11, and forms a gas circulation path CR including, as part thereof, the inside of the container 11. One end portion of the gas path 14 is connected to an upper surface of each reactant 12, and the other end portion is connected to the inside of the container 11. More specifically, portions of the gas path 14 connected to the upper surfaces of the reactants 12 are joined together in the container 11, and after having penetrated the upper bottom portion 11*b* as a single path, further penetrate the lower bottom portion 11*c* through the heat exchanger 50, the gas receiving portion 15, the gas pump 16, and the gas filter 17 in this order and are connected to the inside of the container 11.

The heat exchanger 50 is configured such that part (an upstream-side portion with respect to the gas receiving portion 15) of the gas path 14 is arranged in the heat exchanger 50 and water as a steam source is supplied to the heat exchanger 50. With this configuration, the heat exchanger 50 performs heat exchange between gas in the gas path 14 and supplied water so that the water can be heated to generate steam and the steam can be supplied to the outside of the boiler 4. Note that the heat exchanger 50 of the present embodiment has specifications for heating water to generate steam. Instead, one with specifications for heating water to generate hot water may be employed.

For example, a plate or shell-and-tube heat exchanger may be employed as the heat exchanger 50, or various forms of steam generators may be employed. As one example of these steam generators, there is one having a storage space for storing supplied water and a gas path 14 arranged in the storage space and configured to transmit heat of gas in the gas path 14 to the stored water.

The pressure sensor 25 continuously detects the pressure (a steam pressure) of steam supplied from the heat exchanger 50 to the outside. Note that a detection value (the value of the steam pressure) of the pressure sensor 25 is great under a situation where the amount of steam supplied from the heat exchanger 50 is greater than a steam amount (a steam load) required from the outside, and conversely, is small under a situation where the amount of steam supplied from the heat exchanger 50 is smaller.

Moreover, in the gas path 14 of the boiler 4 as illustrated in FIG. 7, a bypass path 14*a* is provided to connect a position immediately on an upstream side of the heat exchanger 50 and a position immediately on a downstream side of the heat exchanger 50. As described above, the bypass path 14*a* is provided in parallel with the heat exchanger 50, and fulfills a role as a bypass extending around the heat exchanger 50.

Further, in the gas path 14, an adjustment valve 18 is placed at a branched point between a path toward the heat exchanger 50 and the bypass path 14*a*. The adjustment valve 18 can adjust the flow rate of gas (hydrogen-based gas) flowing in the bypass path 14*a*. As the flow rate of gas flowing in the bypass path 14*a* increases, the flow rate of gas flowing in the heat exchanger 50 decreases accordingly.

Next, operation of the boiler 4 will be described. In the boiler 4, the hydrogen-based gas is supplied from an external supply source to the gas receiving portion 15, and the gas circulation path CR including the inside of the container 11 and the gas path 14 is filled with the hydrogen-based gas. Due to action of the gas pump 16, the charged hydrogen-based gas circulates to a direction indicated by dashed arrows in FIG. 4 in the gas circulation path CR.

At this point, in the container 11, the hydrogen-based gas is delivered into the gas path 14 connected to upper portions of the reactants 12 after having flowed in the reactants 12 through mesh-shaped clearances thereof. At the same time, the reactants 12 are heated by action of the heaters 13. When the reactants 12 are, as described above, heated by the heaters 13 in a state in which the hydrogen-based gas has been supplied into the container 11, hydrogen atoms are stored in metal nanoparticles provided on the reactants 12, and the reactants 12 generate an excess heat of equal to or higher than the temperature of heating by the heater 13.

When passing through the container 11, the hydrogen-based gas is heated to a high temperature by heat generated by the reactants 12. Then, the high-temperature hydrogen-based gas is delivered to the heat exchanger 50 through the gas path 14. Accordingly, water supplied to the heat exchanger 50 is heated by heat exchange with the high-temperature hydrogen-based gas, and turns into steam. Such steam is supplied from the heat exchanger 50 to the outside.

The amount of steam supplied from the heat exchanger 50 to the outside is, by the controller 26, adjusted based information on the detection value of the pressure sensor 25. Such adjustment can be implemented in such a manner that a heat generation amount of the reactant 12 is increased such that a steam generation amount increases when the detection value of the pressure sensor 25 is smaller than a proper value and is decreased such that the steam generation amount decreases when the detection value of the pressure sensor 25 is greater than the proper value.

Note that the heat generation amount of the reactant 12 can be controlled by adjustment of the temperature of the heater 13 or the above-described gas circulation amount by the controller 26. As the temperature of the heater 13 increases or the circulation amount increases, the heat generation amount of the reactant 12 can be increased. Moreover, in the heat exchanger 50, water is sequentially supplied by an amount corresponding to a steam supply to the outside, i.e., a water decrement, and therefore, steam can be continuously generated and supplied to the outside.

As described above, the boiler 4 includes the reactants 12, the container 11 having the reactants 12 inside and configured so that the inside of the container 11 can be filled with gas (the hydrogen-based gas) with higher specific heat than that of air, the gas circulation path CR including the container 11 and the gas path 14 as a path for circulating the hydrogen-based gas, and the heat exchanger 50 configured to heat water by heat exchange with the hydrogen-based gas in the gas path 14 to generate steam. Thus, according to the boiler 4, heat held by circulating gas can be efficiently utilized for heating water, and such heat can be more effectively utilized.

Further, the temperature of gas in the gas path 14 decreases by way of the heat exchanger 50, and accordingly, the temperature of gas when the gas passes through a device (in the example of the present embodiment, the gas pump 16 or the gas filter 17) arranged on the downstream side with respect to the heat exchanger 50 can be decreased. Thus, a heatproof temperature (a required heatproof temperature) required for such a device can be also decreased.

In addition, by flow rate adjustment by the adjustment valve 18, as the flow rate of gas flowing in the heat exchanger 50 decreases, heating of water in the heat exchanger 50 can be weakened, and the steam generation amount can be decreased. Conversely, as the flow rate of gas flowing in the heat exchanger 50 increases, heating of water in the heat exchanger 50 can be strengthened, and the steam generation amount can be increased. Note that gas flowing in the bypass path 14*a* is returned to the gas path 14 at a position immediately on the downstream side of the heat exchanger 50. Thus, the flow rate of gas in the gas path 14 on the downstream side with respect to such a position does not depend on the flow rate of gas flowing in the bypass path 14*a*.

In the present embodiment, the bypass path 14*a* and the adjustment valve 18 are provided so that the amount of steam supplied from the heat exchanger 50 to the outside can be adjusted by the control of the adjustment valve 18 by the controller 26. Such adjustment can be implemented in such a manner that the adjustment valve 18 is controlled such that the flow rate of gas flowing in the heat exchanger 50 increases when the detection value of the pressure sensor 25 is smaller than the proper value and is controlled such that the flow rate of gas flowing in the heat exchanger 50 decreases when the detection value of the pressure sensor 25 is greater than the proper value.

Note that the controller 26 may adjust both of the flow rate of gas flowing in the bypass path 14*a* and the heat generation amount of the reactant 12 based on the detection value (the pressure of steam supplied from the heat exchanger 50 to the outside) of the pressure sensor 25. With this configuration, both of the flow rate and the heat generation amount can be changed with favorable balance, and the amount of steam supplied from the heat exchanger 50 to the outside can be adjusted.

Alternatively, which one of the flow rate or the heat generation amount is to be adjusted may be set as necessary. For adjustment of the heat generation amount of the reactant 12, the controller 26 adjusts both items of the temperature of the heater 13 and the hydrogen-based gas circulation amount according to the detection value of the pressure sensor 25. Note that according to various situations, only either one of the items may be adjusted instead of adjusting both items described above. As necessary, which one of these items is to be adjusted can be set.

5. Fifth Embodiment

Next, a fifth embodiment of the present invention will be described. Note that the fifth embodiment is basically similar to the fourth embodiment, except for the form of a heat generation body and points relating thereto. In description below, description of contents different from those of the fourth embodiment will be focused, and description of contents common to the fourth embodiment might be omitted.

Figure 8:
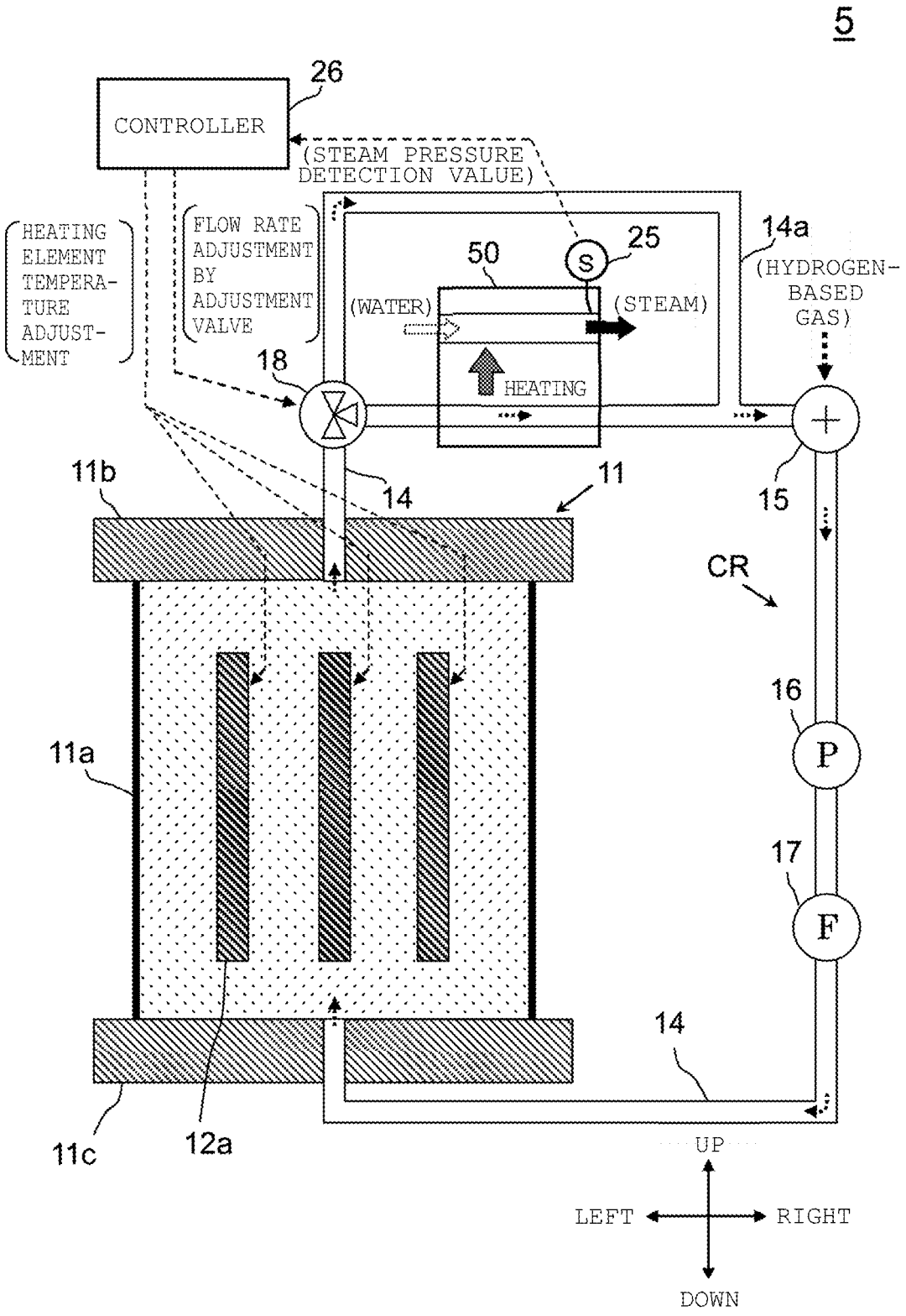
FIG. 8 is a schematic configuration diagram of a boiler 5 according to a fifth embodiment.

FIG. 8 is a schematic configuration diagram of a boiler 5 in the fifth embodiment. The reactant 12 is employed as the heat generation body in the boiler 4 of the fourth embodiment. Instead, a general heat generation element 12*a* is employed in the fifth embodiment. Note that the heat generation element 12*a* described herein is, as one example, a halogen heater configured to generate heat by a power supply. Moreover, for the sake of convenience, the shape and dimensions of the heat generation element 12*a* are similar to those of the reactant 12.

In a case where the heat generation element 12*a* is applied as a heat generation body, excess heat is not necessarily generated as in the fourth embodiment, and one equivalent to a heater 13 is not necessary and placement thereof is omitted. Moreover, an upstream-side end portion of a gas path 14 in the fifth embodiment is connected to an upper bottom portion 11*b* instead of the heat generation element 12*a*, and is connected to a space in a container 11.

In the boiler 5, gas (hydrogen-based gas) in the container 11 is heated by heat generated from the heat generation elements 12*a* instead of the reactants 12, and such high-temperature gas is delivered to a heat exchanger 50 through the gas path 14. Accordingly, water supplied to the heat exchanger 50 is heated by heat exchange with the high-temperature gas, and turns into steam. Such steam is supplied from the heat exchanger 50 to the outside. Moreover, in the fifth embodiment, the above-described reaction for generating the excess heat is not necessary, and a controller 26 can directly control the temperature of the heat generation body (the heat generation element 12*a*) by power control.

6. Sixth Embodiment

Next, a sixth embodiment of the present invention will be described. Note that in description below, description of contents different from those of the fourth embodiment will be focused, and description of contents common to the fourth embodiment might be omitted.

Figure 9:
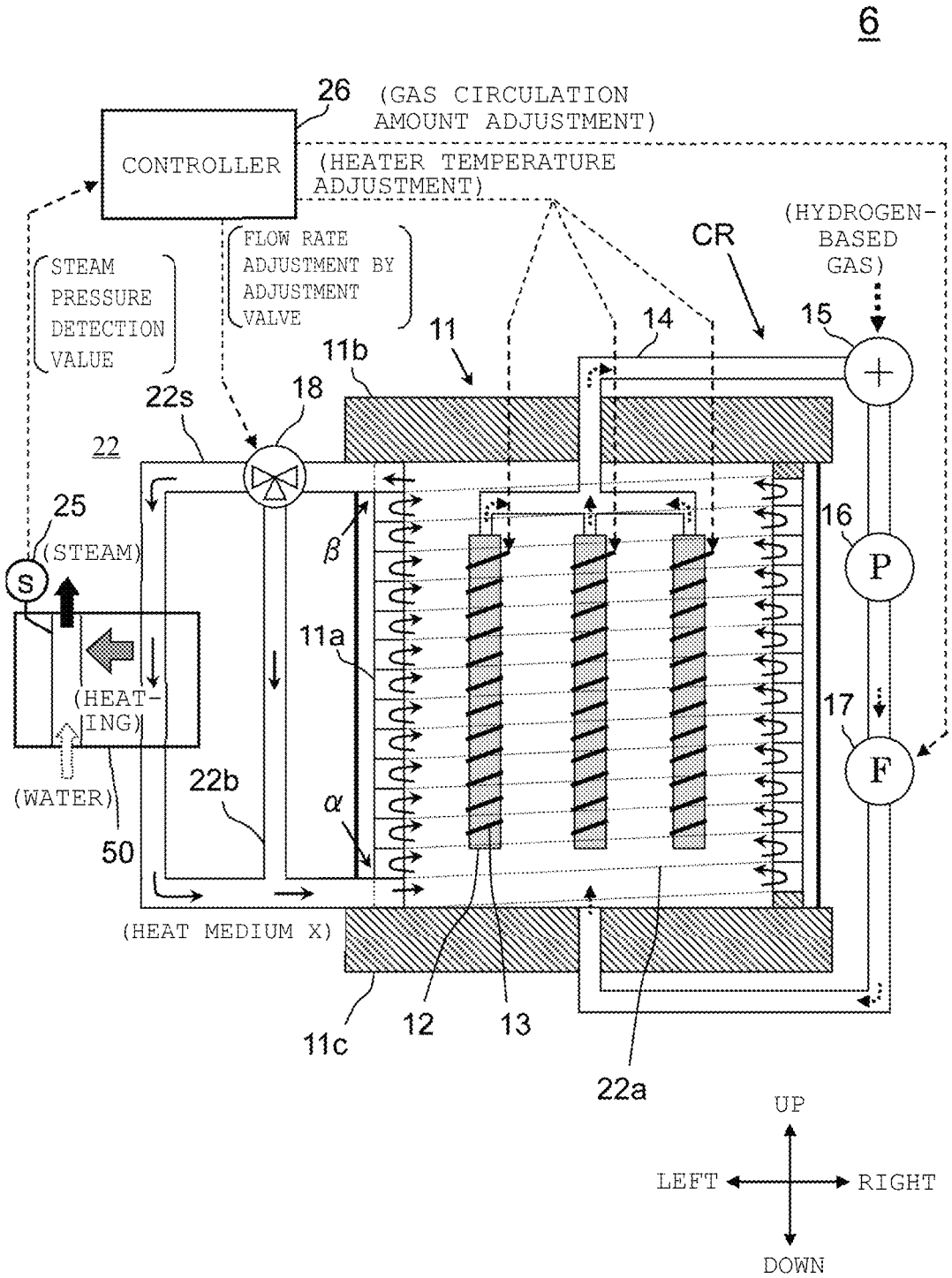
FIG. 9 is a schematic configuration diagram of a boiler 6 according to a sixth embodiment.

FIG. 9 is a schematic configuration diagram of a boiler 6 in the sixth embodiment. As illustrated in this figure, a fluid path 22 is provided as a path for circulating a heat medium X in the boiler 6. The heat medium X is supplied in advance to the fluid path 22, and by action of a not-shown pump, the heat medium X circulates from an upstream side to a downstream side (i.e., to a direction indicated by solid arrows in FIG. 9) in the fluid path 22.

Part of the fluid path 22 is formed as a heat transfer pipe 22*a*. The heat transfer pipe 22*a* spirally extends from a lower bottom portion 11*c* to an upper bottom portion 11*b* to form a tubular side wall 11*a* of a container 11. The heat transfer pipe 22*a* spirally extends in an axial direction (an upper-lower direction) of the tubular side wall 11*a* such that no clearance is formed between adjacent portions of the heat transfer pipe 22*a* in the upper-lower direction.

Moreover, a heat exchanger 50 of the sixth embodiment is configured such that part of the fluid path 22 is arranged in the heat exchanger 50 and water as a steam source is supplied to the heat exchanger 50. With this configuration, the heat exchanger 50 performs heat exchange between the heat medium X in the fluid path 22 and supplied water so that the water can be heated to generate steam and the steam can be supplied to the outside of the boiler 6.

Further, in the sixth embodiment, a bypass path 22*b* is provided in the fluid path 22 instead of providing a bypass path 14*a* in a gas path 14. More specifically, in the fluid path 22, the bypass path 22*b* is provided to connect a position immediately on the upstream side of the heat exchanger 50 and a position immediately on the downstream side of the heat exchanger 50. As described above, the bypass path 22*b* is provided in parallel with the heat exchanger 50, and fulfills a role as a bypass extending around the heat exchanger 50.

Note that an adjustment valve 18 in the sixth embodiment is placed at a branched point between a path toward the heat exchanger 50 and the bypass path 22*b* in the fluid path 22, and can adjust the flow rate of the heat medium X flowing in the bypass path 22*b*. As the flow rate of the heat medium X flowing in the bypass path 22*b* increases, the flow rate of the heat medium X flowing in the heat exchanger 50 decreases accordingly.

The boiler 6 of the present embodiment circulates the heat medium X in the fluid path 22 in parallel with the operation of generating heat from reactants 12. When passing through the heat transfer pipe 22*a* forming the side wall 11*a* of the container 11, the heat medium X is heated by heat generated by the reactants 12. That is, heat generated by the reactants 12 is transmitted to the heat transfer pipe 22*a* by convection (heat transfer), heat conduction, and radiation by hydrogen-based gas in the container 11, and the heat transfer pipe 22*a* of which temperature has been increased by such transmission heats the heat medium X flowing in the heat transfer pipe 22*a*. As described above, the heat medium X is heated at least by heat exchange with the hydrogen-based gas heated by the reactants 12. Note that the heat transfer pipe 22*a* of the present embodiment has a configuration equivalent to that of the heat transfer pipe 22*a* of the first embodiment. The heat medium X having reached an inlet (the lowermost portion of the heat transfer pipe 22*a*) of the heat transfer pipe 22*a* flows along the inside of the spirally-extending heat transfer pipe 22*a*, and reaches an outlet (the uppermost portion of the heat transfer pipe 22*a*) of the heat transfer pipe 22*a*. At this point, heat from the heat transfer pipe 22*a* heated by heat generated by the reactants 12 is transmitted to the heat medium X passing through the heat transfer pipe 22*a*, and the temperature of the heat medium X increases.

In this manner, the heat medium X flowing in the fluid path 22 is heated when passing through the heat transfer pipe 22*a* such that the temperature thereof increases, and is delivered to the heat exchanger 50. Accordingly, water supplied to the heat exchanger 50 is heated by heat exchange with the high-temperature heat medium X, and turns into steam. Such steam is supplied from the heat exchanger 50 to the outside. Note that, e.g., the control of the adjustment valve 18 is performed in a manner equivalent to that in the case of the fourth embodiment by the controller 26.

Moreover, the heat transfer pipe 22*a* forms the entire periphery of the side wall 11*a* formed in the tubular shape, and therefore, heat generated by the reactants 12 can be efficiently transmitted to the heat medium X. The heat transfer pipe 22*a* is arranged to surround the reactants 12, and therefore, the substantially entire area of the periphery of the side wall 11*a* can be covered and heat generated by the reactants 12 can be transmitted to the heat medium X with as least waste as possible. Note that in the present embodiment, the heat transfer pipe 22*a* spirally extends and is arranged to surround the reactants 12, but the form surrounding the reactants 12 is not limited to above. For example, a form in which multiple heat transfer pipes extending in the vertical direction are arranged to surround the reactants 12 may be employed.

Further, in the present embodiment, the side wall 11*a* for sealing gas in the container 11 is formed by the heat transfer pipe 22*a*. Instead, the side wall 11*a* may be provided separately from the heat transfer pipe 22*a*, and the heat transfer pipe 22*a* may be provided inside the side wall 11*a* (i.e., in the container 11). In this case, the heat transfer pipe 22*a* does not necessarily fulfill a function as the side wall 11*a*, but preferably fulfills such a function because the heat transfer pipe 22*a* more easily receives heat from the reactants 12 when there is a clearance between adjacent portions of the heat transfer pipe 22*a* in the upper-lower direction.

Each of the boilers 4 to 6 of the fourth to sixth embodiments described above includes the heat generation bodies, the container 11 including the heat generation bodies inside and configured so that the inside of the container 11 can be filled with gas with higher specific heat than that of air, and the heat exchanger 50 configured to heat water by heat exchange with fluid heated by heat of the heat generation bodies. In the path for such fluid, the bypass path 14*a* (or 22*b*) is provided in parallel with the heat exchanger 50. Thus, each of the boilers 4 to 6 of the embodiments heats water by utilizing fluid directly or indirectly heated by the heat generation bodies in the container 11, and adjusts the flow rate of fluid flowing in the bypass path. Thus, heating of water can be easily adjusted.

Note that each of the boilers 4 to 6 includes the heat exchanger 50 provided outside the container 11 and configured such that fluid as the hydrogen-based gas heated by the heat generation bodies or the heat medium X heat-exchanged with the hydrogen-based gas passes through a heating side and the bypass path 14*a* provided in parallel with the heat exchanger 50 and bypassing the heating side of the heat exchanger 50. The heat exchanger 50 has the heating side (a portion through which relatively-high-temperature fluid passes) and a heated side (a portion through which relatively-low-temperature fluid passes), and is formed to perform heating by heat transfer from heating-side fluid to heated-side fluid.

Further, a radiator may be placed in the bypass path of each embodiment such that extra heat is released from fluid flowing in the bypass path. Note that a thermoelectric element may be placed in the bypass path in addition to or instead of the radiator, and electricity obtained by the thermoelectric element may be utilized as, e.g., stored power or drive power for the heater 13 (in the case of the fifth embodiment, the heat generation element 12*a*).

In addition, in each boiler of the fourth and fifth embodiments, the hydrogen-based gas with higher specific heat than that of air is applied as gas used for heat exchange with water in the heat exchanger 50. By application of such gas with higher specific heat, it is less likely to fluctuate the temperature of gas used for heat exchange, and heat can be more stably transmitted to water. Note that in each boiler of the fourth to sixth embodiments, the hydrogen-based gas is employed as gas with higher specific heat than that of air. However, the reaction for generating the excess heat is not necessary in the boiler 5 of the fifth embodiment, and therefore, gas other than the hydrogen-based gas may be employed as the above-described gas with higher specific heat than that of air.

7. Seventh Embodiment

Next, a seventh embodiment of the present invention will be described. Note that the seventh embodiment is basically similar to the first embodiment, except for points relating to the form of a heat transfer pipe. In description below, description of contents different from those of the first embodiment will be focused, and description of contents common to the first embodiment might be omitted.

Figure 10:
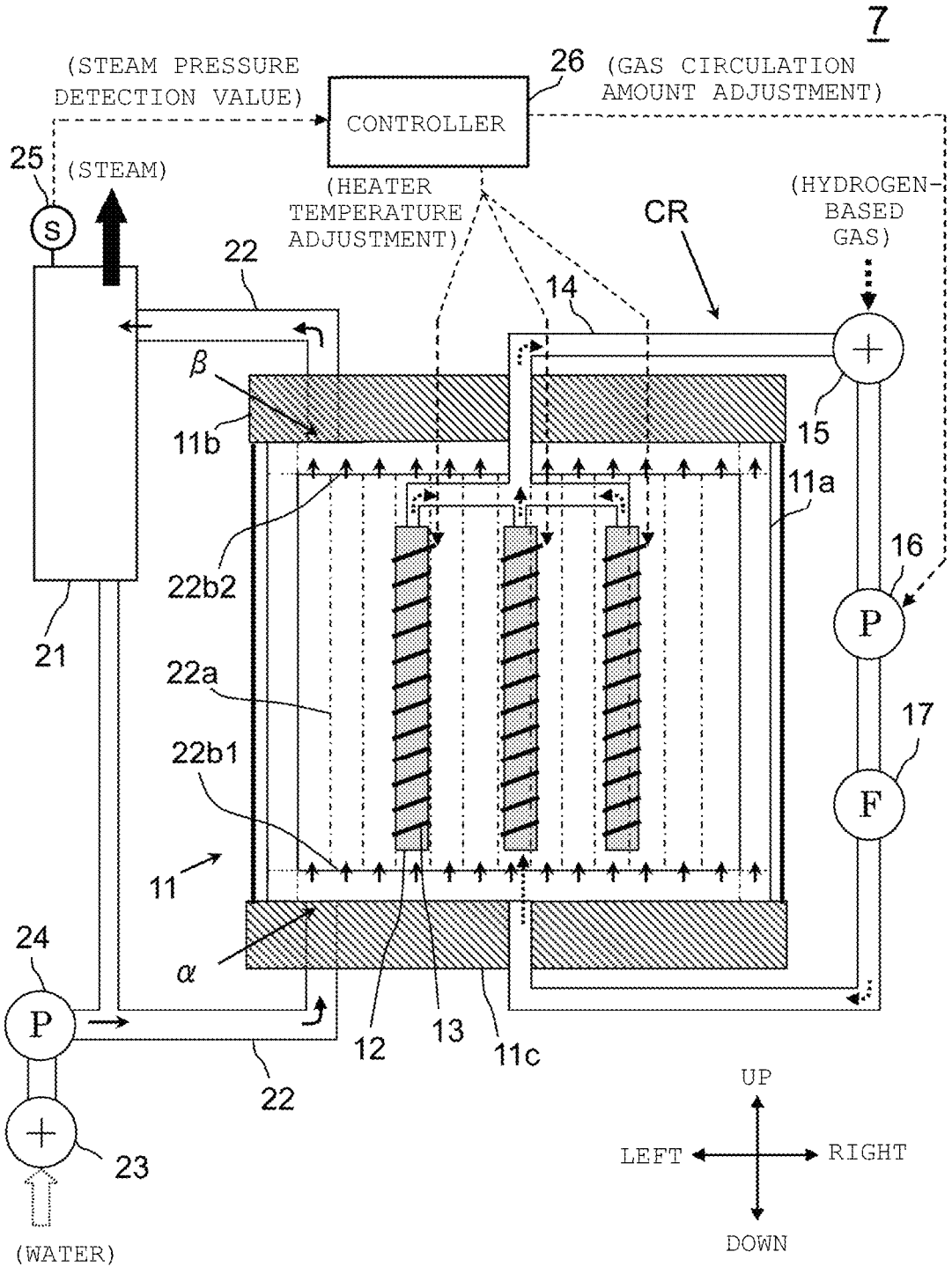
FIG. 10 is a schematic configuration diagram of a boiler 7 according to a seventh embodiment.

FIG. 10 is a schematic configuration diagram of a boiler 7 according to the seventh embodiment. As illustrated in this figure, a fluid path 22 in the seventh embodiment includes a lower header 22*b*1 and an upper header 22*b*2 in addition to multiple heat transfer pipes 22*a* extending up and down in the vertical direction.

The lower header 22*b*1 extends to form a circular shape on a lower side of a side wall 11*a* in a cylindrical shape, and at a lower left portion thereof, an inlet α of the lower header 22*b*1 is formed. The upper header 22*b*2 extends to form a circular shape on an upper side of the side wall 11*a* in the cylindrical shape, and at an upper left portion thereof, an outlet β of the upper header 22*b*2 is formed. The lower header 22*b*1 and the upper header 22*b*2 are set to the substantially same shape and dimensions, and are arranged to overlap with each other as viewed from above. A portion of the fluid path 22 extending from a water pump 24 is connected to the inlet α of the lower header 22*b*1, and a portion of the fluid path 22 extending from the outlet β of the upper header 22*b*2 is connected to a separator 21.

The multiple heat transfer pipes 22*a* extend in an upper-lower direction between the lower header 22*b*1 and the upper header 22*b*2, and are arranged next to each other in a circumferential direction of the cylindrical shape of the side wall 11*a* to form the side wall 11*a* in the cylindrical shape. Each of the multiple heat transfer pipes 22*a* is integrated such that there is no clearance between adjacent ones of the heat transfer pipes 22*a* in the circumferential direction.

An internal space of each of the multiple heat transfer pipes 22*a* is connected to an internal space of the lower header 22*b*1 on the lower side, and is connected to an internal space of the upper header 22*b*2 on the upper side. That is, the circular lower header 22*b*1 is connected to lower ends of all of the multiple heat transfer pipes 22*a*, and the circular upper header 22*b*2 is connected to upper ends of all of the multiple heat transfer pipes 22*a*. With this configuration, water having entered the lower header 22*b*1 through the inlet α can reach the outlet β through the heat transfer pipes 22*a*.

Figure 11:
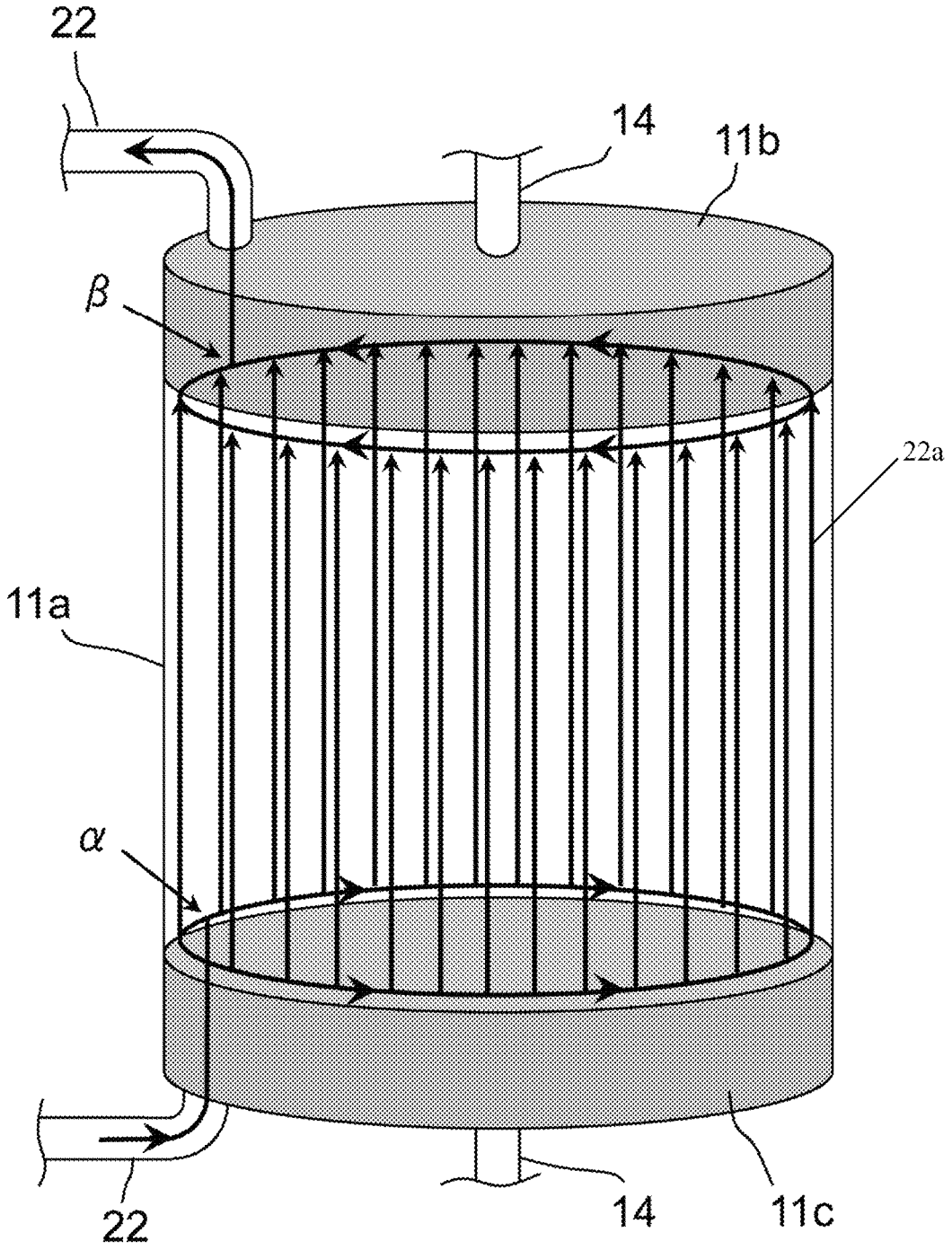
FIG. 11 is a view for describing the course of water passing through heat transfer pipes of the boiler 7.

FIG. 11 schematically illustrates the course of water passing through the heat transfer pipes 22*a* and the periphery thereof by a solid arrow. When water enters the lower header 22*b*1 through the inlet α, the water flows in the circumferential direction along the lower header 22*b*1, and further flows upward along each of the multiple heat transfer pipes 22*a*. Moreover, the water heated in the heat transfer pipes 22*a* reaches, as steam, the upper header 22*b*2, flows in the circumferential direction along the upper header 22*b*2, and is delivered to the separator 21 through the outlet β.

As described above, in the present embodiment, the fluid path 22 has the multiple heat transfer pipes 22*a* extending in an axial direction (the vertical direction) of the tubular side wall 11*a*. These heat transfer pipes 22*a* are arranged in the circumferential direction of the tubular shape to form the side wall 11*a*, and therefore, are arranged to surround heat generation bodies. Thus, in the present embodiment, the heat transfer pipes 22*a* are easily arranged to cover the substantially entire area of the periphery of the side wall 11*a* while the heat transfer pipes 22*a* are arranged to form a once-through boiler or one equivalent thereto. Heat generated by the heat generation bodies can be transmitted to water as a steam source with as least waste as possible. Note that the heat transfer pipes of the present embodiment are multiple water pipes (pipes through which water passes) extending in the vertical direction, and are arranged to surround the heat generation bodies. Moreover, the boiler of the present embodiment is a boiler including the water pipes heated by heat generated by the heat generation bodies and configured such that water is heated by passing through the water pipes, and the water pipes are arranged to surround the heat generation bodies.

8. Eighth Embodiment

Next, an eighth embodiment of the present invention will be described. Note that the eighth embodiment is basically similar to the first embodiment, except that a hydrogen-powered burner is employed as a reactant heating unit instead of a heater. In description below, description of contents different from those of the first embodiment will be focused, and description of contents common to the first embodiment might be omitted.

Figure 12:
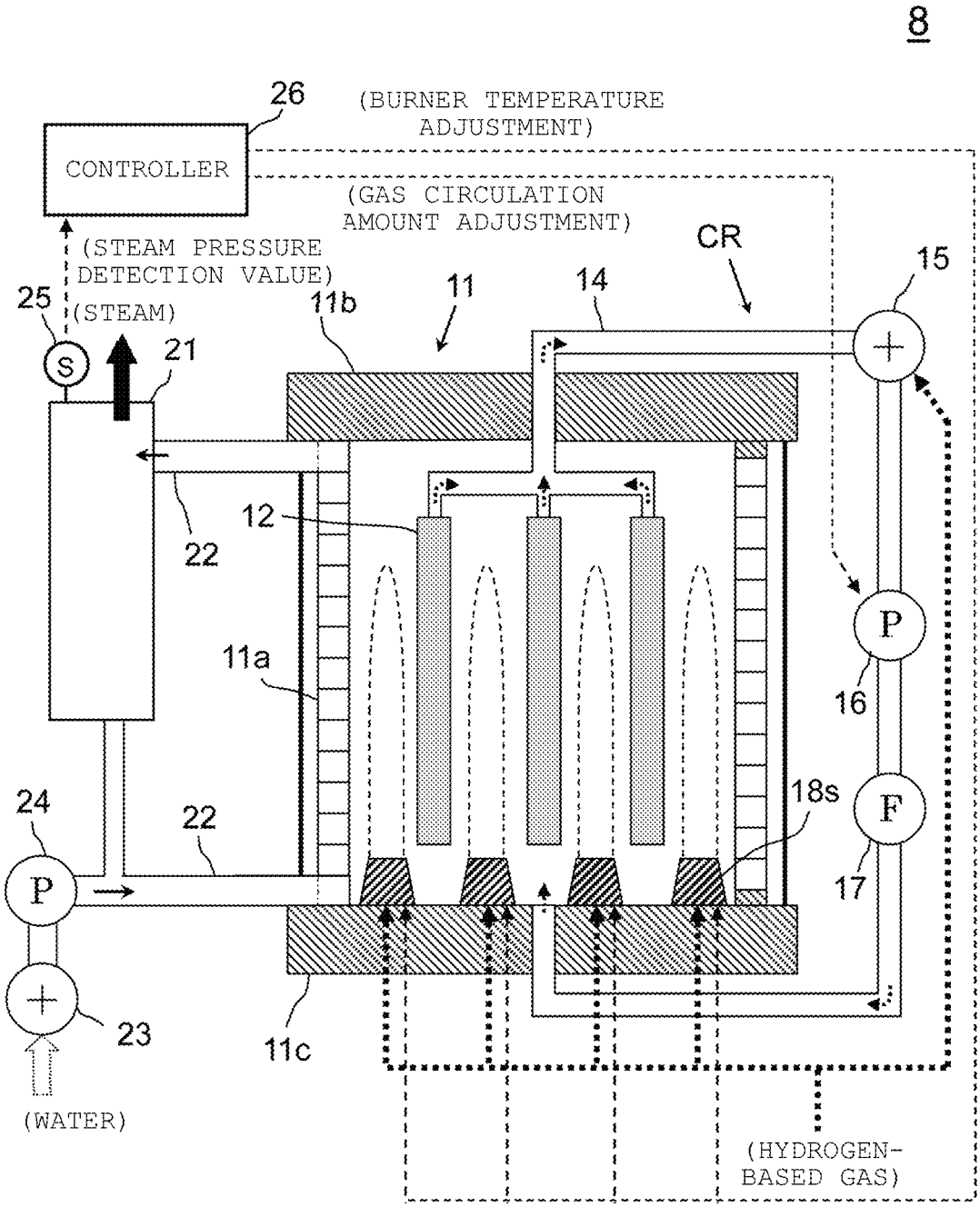
FIG. 12 is a schematic configuration diagram of a boiler 8 according to an eighth embodiment.

FIG. 12 is a schematic configuration diagram of a boiler 8 according to the eighth embodiment. Note that considering visibility in FIG. 12, the solid arrows and the chain lines illustrated in FIG. 1 are omitted. As illustrated in this figure, in the boiler 8, a hydrogen-powered burner 18*s* is provided instead of omitting placement of the heaters 13 (see FIG. 1).

The hydrogen-powered burner 18*s* is a burner using hydrogen-based gas as fuel, and in a container 11, is arranged so that not only reactants 12 but also a side wall 11*a* can be heated. In the example of the present embodiment, the hydrogen-powered burner 18*s* is arranged to spurt combustion flame to among the reactants 12 and the side wall 11*a* to efficiently heat these components. Note that the hydrogen-powered burner 18*s* may be arranged outside the container 11, and may directly heat the side wall 11*a* and heat the reactants 12 through the side wall 11*a*.

In the present embodiment, the hydrogen-powered burner 18*s* fulfills a role in heating the reactants 12, and therefore, placement of the above-described heaters 13 can be omitted, and other external heat sources for increasing the temperature of the reactant 12 are not necessary either. Moreover, a supply source of the hydrogen-based gas supplied as the fuel of the hydrogen-powered burner 18*s* is common to that of hydrogen-based gas supplied to a gas receiving portion 15. With this configuration, the hydrogen-based gas supplied from such a supply source can be efficiently utilized, and it is also advantageous in, e.g., simplification of the configuration of the boiler.

Further, the hydrogen-powered burner 18*s* heats the side wall 11*a* so that water passing through the heat transfer pipes 22*a* can be heated. As described above, in the present embodiment, water can be heated not only by heat generated from the reactants 12, but also by the hydrogen-powered burner 18*s*. Thus, e.g., upon the start-up of the boiler 8, water is heated using the hydrogen-powered burner 18*s* until sufficient heat is generated from the reactants 12, and therefore, steam can be more promptly generated. Specifically, the reactant 12 has such properties that reaction starts after the temperature of the reactant 12 has increased to a predetermined reaction temperature and the reactant 12 gradually generates excess heat, and therefore, water is heated using the hydrogen-powered burner 18*s* upon the start-up so that time necessary until generation of steam can be significantly shortened.

Note that operation of a controller 26 of the present embodiment is basically similar to that of the first embodiment, except that the temperature of the hydrogen-powered burner 18*s* is adjusted instead of the heater. For adjustment of a heat generation amount of the reactant 12, the controller 26 adjusts both items of the temperature of the hydrogen-powered burner 18*s* and a hydrogen-based gas circulation amount according to a detection value of a pressure sensor 25. Note that according to various situations, only either one of the items may be adjusted instead of adjusting both items described above. As necessary, which one of these items is to be adjusted can be set.

9. Other

The boiler of each embodiment described above is the boiler configured to heat fluid by using heat generated by the heat generation bodies, and includes the controller 26 configured to control the heat generation amount of the heat generation body under a situation where the hydrogen-based gas is supplied into the container 11. The boiler according to the present invention heats fluid by the heat generation unit including the heat generation bodies in the container, and can moderately heat fluid according to various situations where heat generated by the heat generation bodies can be efficiently utilized.

The embodiments of the present invention have been described above, but the configurations of the present invention are not limited to those of the above-described embodiments. Various changes can be made without departing from the gist of the invention. That is, the above-described embodiments are examples on all points, and should be considered as not being limited. For example, the boiler according to the present invention is also applicable to a hot water boiler, a heat medium boiler and the like in addition to the boiler generating steam as in the above-described embodiments. The technical scope of the present invention is not determined by description of the above-described embodiments, but is determined by the claims. It should be understood that meaning equivalent to that of the claims and all changes pertaining to the claims are included. Moreover, the present invention can be utilized for boilers for various purposes.

What is claimed is:

1. A boiler for heating fluid by using heat generated by a heat generation body, the boiler including the heat generation body and a container having the heat generation body inside and configured such that an inside of the container is filled with gas with higher specific heat than that of air, comprising:

a controller configured to control a heat generation amount of the heat generation body under a situation where the gas has been supplied into the container, the boiler for supplying, to an outside, steam generated by heating of water as the fluid wherein the controller controls the heat generation amount based on a pressure of the steam supplied to the outside.

2. The boiler according to claim 1, wherein the gas is hydrogen-based gas, and the heat generation body is a reactant configured such that a metal nanoparticle made of hydrogen storing metals is provided on a surface, and a hydrogen atom is stored in the metal nanoparticle to generate excess heat.

3. The boiler according to claim 2, further comprising:

a heat exchanger provided outside the container and configured such that fluid as the gas heated by the heat generation body or a heat medium heat-exchanged with the gas passes through a heating side; and a bypass path provided in parallel with the heat exchanger and bypassing the heating side of the heat exchanger.

4. The boiler according to claim 1, further comprising:

a heater, wherein the controller adjusts a temperature of the heater to control the heat generation amount.

5. The boiler for heating a heat medium as the fluid to supply the heat medium to an outside according to claim 4, wherein the controller controls the heat generation amount based on a temperature of the heated heat medium.

6. The boiler according to claim 1, further comprising:

a heat transfer pipe configured such that the fluid flows inside, wherein the heat transfer pipe is arranged to surround the heat generation body.

7. The boiler according to claim 6, the boiler including a water pipe to be heated by heat generated by the heat generation body and heating water as the fluid when the water passes through the water pipe, wherein the water pipe is arranged to surround the heat generation body.

8. The boiler according to claim 1, wherein the controller controls the heat generation amount so that the pressure of the steam is with a predetermined range.

9. A boiler for heating fluid by using heat generated by a heat generation body, the boiler including the heat generation body and a container having the heat generation body inside and configured such that an inside of the container is filled with gas with higher specific heat than that of air, comprising:

a controller configured to control a heat generation amount of the heat generation body under a situation where the gas has been supplied into the container; and a heat transfer pipe configured such that the fluid flows inside, wherein the heat transfer pipe is arranged to surround the heat generation body, wherein the heat transfer pipe spirally extends and is arranged to surround the heat generation body.

10. The boiler according to claim 9, further comprising:

a heat exchanger provided outside the container and configured such that fluid as the gas heated by the heat generation body or a heat medium heat-exchanged with the gas passes through a heating side; and a bypass path provided in parallel with the heat exchanger and bypassing the heating side of the heat exchanger.

11. The boiler according to claim 9, further comprising:

a heater, wherein the controller adjusts a temperature of the heater to control the heat generation amount.

12. The boiler for heating a heat medium as the fluid to supply the heat medium to an outside according to claim 11, wherein the controller controls the heat generation amount based on a temperature of the heated heat medium.

13. The boiler according to claim 9, further comprising:

a heat exchanger provided outside the container and configured such that fluid as the gas heated by the heat generation body or a heat medium heat-exchanged with the gas passes through a heating side; and a bypass path provided in parallel with the heat exchanger and bypassing the heating side of the heat exchanger.

14. A boiler for heating fluid by using heat generated by a heat generation body, the boiler including the heat generation body and a container having the heat generation body inside and configured such that an inside of the container is filled with gas with higher specific heat than that of air, comprising:

a controller configured to control a heat generation amount of the heat generation body under a situation where the gas has been supplied into the container; and a heat transfer pipe configured such that the fluid flows inside, wherein the heat transfer pipe is arranged to surround the heat generation body, wherein the heat transfer pipe includes multiple water pipes extending in a vertical direction, and the water pipes are arranged to surround the heat generation body.

15. The boiler according to claim 14, further comprising:

a heater, wherein the controller adjusts a temperature of the heater to control the heat generation amount.

16. The boiler for heating a heat medium as the fluid to supply the heat medium to an outside according to claim 15, wherein the controller controls the heat generation amount based on a temperature of the heated heat medium.

17. The boiler according to claim 14, further comprising:

a heat exchanger provided outside the container and configured such that fluid as the gas heated by the heat generation body or a heat medium heat-exchanged with the gas passes through a heating side; and a bypass path provided in parallel with the heat exchanger and bypassing the heating side of the heat exchanger.

18. The boiler according to claim 14, further comprising:

a heat exchanger provided outside the container and configured such that fluid as the gas heated by the heat generation body or a heat medium heat-exchanged with the gas passes through a heating side; and a bypass path provided in parallel with the heat exchanger and bypassing the heating side of the heat exchanger.

19. A boiler for heating fluid by using heat generated by a heat generation body, the boiler including the heat generation body and a container having the heat generation body inside and configured such that an inside of the container is filled with gas with higher specific heat than that of air, comprising:

a controller configured to control a heat generation amount of the heat generation body under a situation where the gas has been supplied into the container; and a heat transfer pipe configured such that the fluid flows inside, wherein the heat transfer pipe is arranged to surround the heat generation body, wherein the heat transfer pipe is heated by conduction, convection, and radiation of heat generated by the heat generation body.

20. The boiler according to claim 19, further comprising:

a heater, wherein the controller adjusts a temperature of the heater to control the heat generation amount.

21. The boiler for heating a heat medium as the fluid to supply the heat medium to an outside according to claim 20, wherein the controller controls the heat generation amount based on a temperature of the heated heat medium.

22. The boiler according to claim 19, further comprising:

a heat exchanger provided outside the container and configured such that fluid as the gas heated by the heat generation body or a heat medium heat-exchanged with the gas passes through a heating side; and a bypass path provided in parallel with the heat exchanger and bypassing the heating side of the heat exchanger.

23. The boiler according to claim 19, further comprising:

a heat exchanger provided outside the container and configured such that fluid as the gas heated by the heat generation body or a heat medium heat-exchanged with the gas passes through a heating side; and a bypass path provided in parallel with the heat exchanger and bypassing the heating side of the heat exchanger.

* * * * *